US011427964B2

(12) United States Patent
Furman, Jr. et al.

(10) Patent No.: US 11,427,964 B2
(45) Date of Patent: Aug. 30, 2022

(54) QUATERNARY CATIONIC SURFACTANTS AND POLYMERS FOR USE AS RELEASE AND COATING MODIFYING AGENTS IN CREPING AND TISSUE PAPERS

(71) Applicant: ECOLAB USA INC., St. Paul, MN (US)

(72) Inventors: Gary S. Furman, Jr., St. Charles, IL (US); Christopher Kaley, Hoffman Estates, IL (US); Zhengang Zong, Aurora, IL (US)

(73) Assignee: Ecolab USA Inc., St. Paul, MN (US)

( * ) Notice: Subject to any disclaimer, the term of this patent is extended or adjusted under 35 U.S.C. 154(b) by 15 days.

(21) Appl. No.: 17/056,715

(22) PCT Filed: Jun. 7, 2019

(86) PCT No.: PCT/US2019/035984
§ 371 (c)(1),
(2) Date: Nov. 18, 2020

(87) PCT Pub. No.: WO2019/241056
PCT Pub. Date: Dec. 19, 2019

(65) Prior Publication Data

US 2021/0198848 A1 Jul. 1, 2021

Related U.S. Application Data

(60) Provisional application No. 62/683,761, filed on Jun. 12, 2018.

(51) Int. Cl.

| | |
|---|---|
| ***D21H 17/06*** | (2006.01) |
| ***D21H 21/14*** | (2006.01) |
| ***B31F 1/14*** | (2006.01) |
| ***D21F 5/18*** | (2006.01) |
| ***D21F 11/00*** | (2006.01) |
| ***D21H 17/07*** | (2006.01) |
| ***D21H 17/56*** | (2006.01) |

(52) U.S. Cl.
CPC ..... *D21H 21/146* (2013.01); *B31F 1/14* (2013.01); *D21F 5/181* (2013.01); *D21F 11/006* (2013.01); *D21H 17/06* (2013.01); *D21H 17/07* (2013.01); *D21H 17/56* (2013.01)

(58) Field of Classification Search
CPC ..... D21H 21/146; D21H 17/06; D21H 17/07; D21H 17/455; D21H 17/56; D21F 11/006; D21F 5/181; D21F 1/14
USPC ..... 162/111
See application file for complete search history.

(56) References Cited

U.S. PATENT DOCUMENTS

| | | | |
|---|---|---|---|
| 3,152,188 | A | 10/1964 | Kirkpatrick et al. |
| 3,678,098 | A | 7/1972 | Lewis et al. |
| 3,718,639 | A | 2/1973 | Falkehag et al. |
| 4,054,542 | A | 10/1977 | Buckman et al. |
| 4,155,855 | A | 5/1979 | Goffinet et al. |
| 4,166,073 | A | 8/1979 | Bauman |
| 4,381,259 | A | 4/1983 | Homma et al. |
| 4,390,689 | A | 6/1983 | Jacquet et al. |
| 4,506,081 | A | 3/1985 | Fenyes et al. |
| 4,605,707 | A | 8/1986 | Reimschuessel et al. |
| 4,978,685 | A | 12/1990 | Gannon et al. |
| 4,995,944 | A | 2/1991 | Aston et al. |
| 5,171,350 | A | 12/1992 | Stainer |
| 5,643,498 | A | 7/1997 | Li et al. |
| 5,716,917 | A | 2/1998 | Williams et al. |
| 5,735,941 | A | 4/1998 | Feeman et al. |
| 5,783,092 | A | 7/1998 | Brown et al. |
| 5,912,306 | A | 6/1999 | Pudney et al. |
| 6,153,568 | A | 11/2000 | McCanna et al. |
| 6,238,521 | B1 | 5/2001 | Shing et al. |
| 6,436,237 | B1 | 8/2002 | Berckmans et al. |
| 6,472,360 | B1 | 10/2002 | Beggs et al. |
| 6,656,977 | B2 | 12/2003 | Slone et al. |
| 6,784,168 | B1 | 8/2004 | Jones et al. |
| 6,969,443 | B1 | 11/2005 | Kokko |
| 7,399,821 | B2 | 7/2008 | Mandeville, III et al. |
| 7,431,799 | B2 | 10/2008 | Antal et al. |
| 7,939,485 | B2 | 5/2011 | Price et al. |
| 7,947,854 | B2 | 5/2011 | Widmer et al. |
| 7,951,754 | B2 | 5/2011 | Tiwari et al. |
| 8,012,461 | B2 | 9/2011 | Whiteley et al. |
| 8,163,075 | B2 | 4/2012 | Kennedy et al. |

(Continued)

FOREIGN PATENT DOCUMENTS

| | | | |
|---|---|---|---|
| CN | 101486657 | A | 7/2009 |
| CN | 101560380 | A | 10/2009 |

(Continued)

OTHER PUBLICATIONS

Angeloni, Annino Santa et al., The Mannich bases in polymer synthesis: 3. Reduction of poly(β-aminoketone)s to poly(γ-aminoalcohols)s and their N-alkylation to poly(γ-hydroxy quaternary ammonium salt)s, Polymer (Oct. 1982) 23(11): 1693-1697.

(Continued)

*Primary Examiner* — Mark Halpern
(74) *Attorney, Agent, or Firm* — Eric D. Babych; Barnes & Thornburg LLP

(57) ABSTRACT

A composition is disclosed that may include an adhesive agent and a release aid. A Yankee dryer coating is also disclosed that may include a release aid. The release aid may include a cationic polymer salt that is a reaction product of a polyamine or a polyalkyleneimine and a substituted alkyl trialkyl quaternary ammonium salt. Also provided are methods of treating and creping paper.

19 Claims, 1 Drawing Sheet

(56) References Cited

U.S. PATENT DOCUMENTS

| | | | |
|---|---|---|---|
| 8,512,722 | B2 | 8/2013 | Lee et al. |
| 9,216,944 | B2 | 12/2015 | Moonen et al. |
| 9,247,736 | B2 | 2/2016 | Ylitalo et al. |
| 9,642,369 | B2 | 5/2017 | Porosa et al. |
| 2004/0180970 | A1 | 9/2004 | Kretz et al. |
| 2006/0013798 | A1 | 1/2006 | Henry et al. |
| 2006/0180794 | A1 | 8/2006 | Goddard et al. |
| 2008/0286225 | A1 | 11/2008 | Schonemyr et al. |
| 2009/0176887 | A1 | 7/2009 | Vlasaty et al. |
| 2010/0280203 | A1 | 11/2010 | Feuerhake et al. |
| 2011/0166236 | A1 | 7/2011 | Tangestani-Nejad et al. |
| 2011/0177145 | A1 | 7/2011 | Erkenbrecher, Jr. et al. |
| 2013/0011357 | A1 | 1/2013 | Molenda et al. |
| 2015/0351383 | A1 | 12/2015 | Kolari et al. |
| 2015/0352029 | A1 | 12/2015 | Tokunaga et al. |
| 2015/0361276 | A1 | 12/2015 | Mahmoud |
| 2016/0000690 | A1 | 1/2016 | Tokunaga et al. |
| 2016/0068476 | A1 | 3/2016 | Moonen et al. |
| 2016/0095876 | A1 | 4/2016 | Salamone et al. |
| 2016/0143275 | A1 | 5/2016 | Lan et al. |
| 2016/0249606 | A1 | 9/2016 | Hartgrove et al. |

FOREIGN PATENT DOCUMENTS

| | | | |
|---|---|---|---|
| CN | 102631954 | A | 8/2012 |
| CN | 102887989 | A | 1/2013 |
| CN | 102924299 | A | 2/2013 |
| CN | 103113872 | A | 5/2013 |
| CN | 103464050 | A | 12/2013 |
| CN | 103483550 | A | 1/2014 |
| CN | 103936603 | A | 7/2014 |
| CN | 104957133 | A | 10/2015 |
| CN | 105010387 | A | 11/2015 |
| CN | 105037176 | A | 11/2015 |
| CN | 105038738 | A | 11/2015 |
| CN | 105104399 | A | 12/2015 |
| CN | 104479169 | B | 3/2017 |
| EP | 0803498 | A1 | 10/1997 |
| EP | 2468713 | A1 | 6/2012 |
| GB | 25085433 | A | 4/1982 |
| GB | 2160538 | A | 12/1985 |
| JP | S5430109 | A | 3/1979 |
| JP | S62238337 | A | 10/1987 |
| JP | H02216297 | A | 8/1990 |
| JP | H0551352 | A | 3/1993 |
| JP | H08188560 | A | 7/1996 |
| JP | 2002317193 | A | 10/2002 |
| JP | 4057796 | B2 | 3/2008 |
| JP | 2008222761 | A | 9/2008 |
| JP | 2009067699 | A | 4/2009 |
| JP | 2011132284 | A | 7/2011 |
| NO | 200003151 | A | 12/2000 |
| WO | 2000039241 | A | 7/2000 |
| WO | 2005097732 | A1 | 10/2005 |
| WO | 2011084996 | A2 | 7/2011 |
| WO | 2013077855 | A1 | 5/2013 |
| WO | 2014008379 | A2 | 1/2014 |
| WO | 2014098871 | A2 | 6/2014 |
| WO | 2014107329 | A1 | 7/2014 |
| WO | 2016105338 | A1 | 6/2016 |

OTHER PUBLICATIONS

Ayfer, Burcu et al., "Synthesis and antibacterial activities of new quaternary ammonium monomers," Designed Monomers and Polymers (2005) 8(5): 437-451.

Badawy, Mohamed E.I. et al., "Antimicrobial and inhibitory enzyme activity of N-(benzyl) and quaternary N-(benzyl) chitosan derivatives on plant pathogens," Carbohydrate Polymers (Oct. 2014) 111: 670-682.

Duan, Ming et al., "Treatment of wastewater produced from polymer flooding using polyoxyalkylated polyethyleneimine," Separation and Purification Technology (Sep. 8, 2014) 133: 160-167.

Kim, Tae-Seong et al., "Preparation and Properties of Multiple Ammonium Salts Quatemized by Epichlorohydrin," Langmuir (1996) 12: 6304-6308.

Li, Jie et al., "Synthesis and Properties of the Dendritic Tetrameric Surfactants," Advanced Materials Research (2011) 183-185: 1667-1671.

Mei, Ping et al, "Synthesis of cationic gemini surfactants of special functional groups," Chemical Engineer (2008) 154(7): 31-33, and 45 (English Abstract on first page).

Miao, Zongcheng et al., "Preparation of Novel Gemini Quaternary Ammonium Salt Cationic Surfactant," Applied Mechanics and Materials (2012) 174-177: 1433-1436.

Raymond, Jon et al., "Determining Effective Antimicrobial Treatments for Long-Term Protection of Hydrocarbon Reservoirs," NACE—International Corrosion Conference Series, 2014, Paper No. 3879: 1-15.

Sao, Ikeda, et al, "Synthesis and Properties of Novel Germini Cationic Surfactants (II)-Multiple Quaternary Ammonium Salts from Dodecylamine and Epichlorohydrin," China Surfactant Detergent & Cosmetics (2001) 31(4): 36-38 (English Abstract on last page).

Timofeeva, Larisa M. et al., "Nonquaternary poly(diallylammonium) polymers with different amine structure and their biocidal effect on *Mycobacterium tuberculosis* and *Mycobacterium smegmatis*," Applied Microbiology Biotechnology (2015) 99(6): 2557-2572.

Wang, Dong et al., "Multiple-stimulus-responsive hydrogels of cationic surfactants and azoic salt mixtures," Colloid and Polymer Science (2013) 291(12) 2935-2946.

Koshimura, Tomokazu et al., "Star-Shaped Trimeric Quaternary Ammonium Bromide Surfactants: Adsorption and Aggregation Properties," Langmuir (2012) 28: 9322-9331.

Yudovin-Farber, Ira et al., "Quaternary Ammonium Polyethyleneimine: Antibacterial Activity," Journal of Nanomaterials, vol. 2010, Article ID 826343: 1-11.

Zhang, Feng et al., "Preparation and Properties of Amino-Terminated Hyperbranched Polymers and Its Quaternary Ammonium Salt," Polymer Materials Science and Engineering, (Aug. 2009) 25(8): 141-144. (English Abstract on last page.).

Zhao-Sheng, C. et al., "Synthesis of 3-Dehydroabietylamino-2-Hydroxypropyl Trimethylammonium Chloride and its Antibacterial Activity," Tenside Surfactants Detergents, (2010) 47(1): 24. (Abstract only.).

International Search Report and Written Opinion for PCT/US2017/065873, dated Mar. 19, 2018, 16 pages.

International Search Report and Written Opinion for PCT/US2019/035984, dated Jul. 30, 2019, 12 pages.

Sun, Yuhai et al., Preparation and Performance of Polymeric Cationic Surfactant, Specialty Petrochemicals, Jingxi Shiyou Huagong, Sep. 2014, 31(5), pp. 35-38, with English translation.

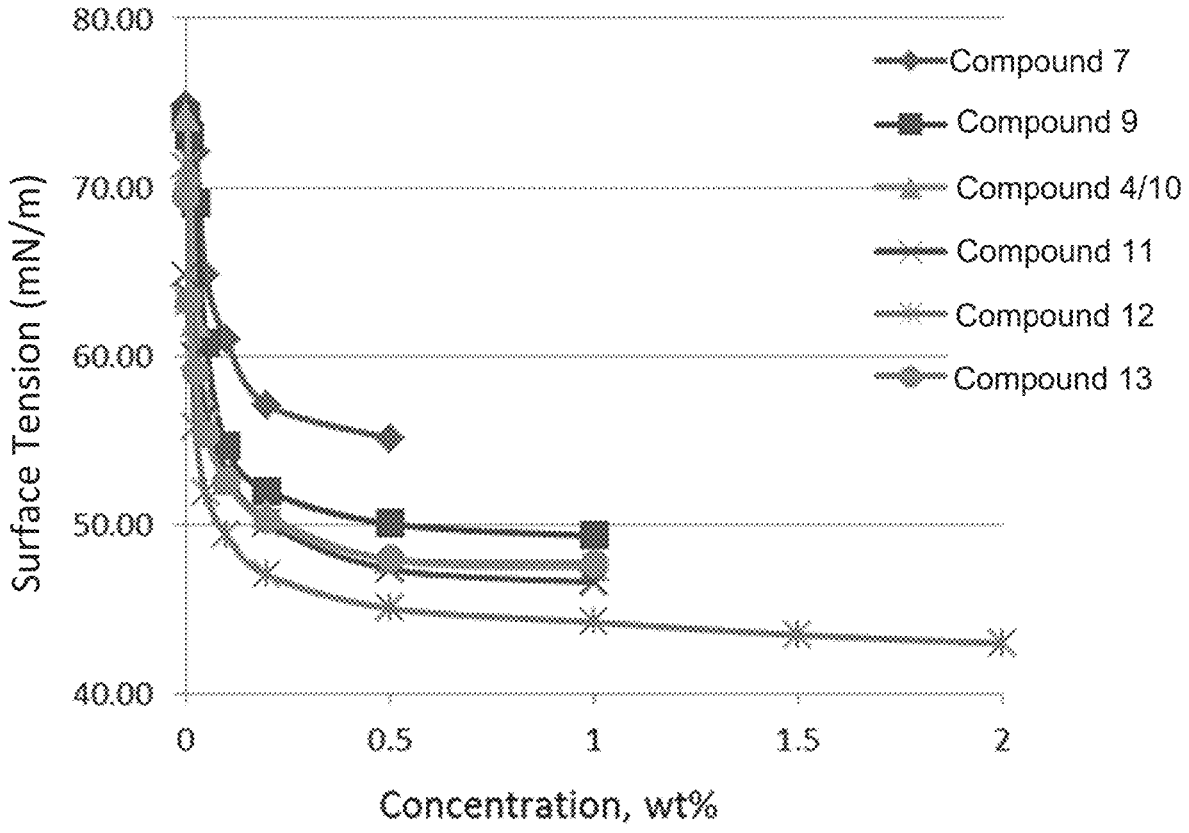
80.00
70.00
60.00
50.00
40.00
Surface Tension (mN/m)
0
0.5
1
1.5
2
Concentration, wt%
Compound 7
Compound 9
Compound 4/10
Compound 11
Compound 12
Compound 13

QUATERNARY CATIONIC SURFACTANTS AND POLYMERS FOR USE AS RELEASE AND COATING MODIFYING AGENTS IN CREPING AND TISSUE PAPERS

FIELD OF THE INVENTION

This disclosure generally relates to compositions of quaternary cationic compounds, and more particularly to compositions for use in papermaking applications.

BACKGROUND

Paper products can be formed by draining a cellulosic fiber suspension through a forming fabric to create the paper web. The cellulosic fiber suspension is deposited onto the forming fabric by means of a headbox which uniformly deposits the suspension. Depending on machine type, there can be some initial vacuum or centrifugal dewatering of the web. For wet pressed tissue papers, the web is further dewatered at the pressure roll, where the sheet is pressed between the pressure roll and the Yankee dryer to a typical consistency of 40-45%. Final drying is accomplished by the steam heated Yankee dryer in combination with hot air impingement hoods. For through-air-dried tissue papers, the web is further dried by the through-air dryer(s) which force hot air through the web to obtain a typical consistency of 60-85%. Final drying is accomplished by the steam heated Yankee dryer in combination with hot air impingement hoods.

The creping process involving a Yankee dryer typically imparts characteristic properties of tissue paper, such as softness, bulk, absorbency, and ability to stretch. In conventional tissuemaking, the tissue is fed to the Yankee Dryer apparatus as a wet fiber web. The wet fiber web is significantly dewatered at a pressure roll nip where the sheet is transferred to the surface of a Yankee Dryer cylinder. At this point, the paper web typically has 35-45% consistency. The sheet is further dried by the steam-heated Yankee Dryer cylinder and hot air impingement hoods to 90-98% consistency and removed with a doctor blade. The mechanical action of the blade results in a disruption of the fiber-fiber bonds, which forms a microfold structure that gives the tissue paper its characteristic properties. This process is referred to as creping.

To properly crepe a paper web to make soft tissue paper, the paper web has to adhere to the surface of the Yankee dryer cylinder. An adhesive is applied to the surface of the Yankee dryer. Adhesion of the paper web to the Yankee dryer can also be facilitated from contributions of wet end furnish components. Adhesion is an important property of Yankee coatings. Higher adhesion can result in better debonding of the sheet at the crepe blade and enhance sheet properties, such as bulk, absorbency, and softness. When the paper web collides with the doctor blade, micro folds are formed in the machine direction, and the web is separated from the drying cylinder.

Creping the paper sheet when it has a very low sheet moisture level (<3%) is a very effective way of achieving desired levels of high softness and bulk. At low moisture levels, the sheet and the coating tend to adhere to each other more strongly which causes the sheet to debond in the Z direction more efficiently thereby generating greater bulk and softness.

Softness is a tactile sensation perceived by the consumer holding a particular product, rubbing it across the skin or crumpling it within the hand. Softness comprises two components, bulk softness and surface softness. Bulk softness relates to how easily the paper product flexes, crumples, or otherwise yields to even delicate counter forces. Surface softness relates to how smooth or with how much lubricity the paper product can be slid against another surface. Both of these forms of softness can be achieved by mechanical means. For example, the sheet can be calendered to flatten the crests formed when creping the sheet and improve surface softness. Through-air-drying of the sheet improves bulk softness. However, mechanical approaches by themselves are often insufficient to meet consumer softness demands.

One way to make the paper softer is to add a softening compound to the cellulosic suspension. The softening compound interferes with the natural fiber-to-fiber bonding that occurs during sheet formation in papermaking processes. This reduction of bonding leads to a softer, or less harsh, sheet of paper.

BRIEF SUMMARY

A composition is disclosed that may include an adhesive agent; and a release aid comprising a cationic polymer salt. The cationic polymer salt comprising a reaction product of a polyamine or a polyalkyleneimine and a substituted alkyl trialkyl quaternary ammonium salt of formula (I):

(I)

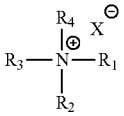

wherein each $X^-$ is independently an anion; $R_1$ is $C_1$-$C_6$ alkylene substituted with hydroxyl or —$OR_5$ and an $X^-$ end group; $R_2$, $R_3$, and $R_4$ are each independently $C_1$-$C_{22}$ alkyl or $C_7$-$C_{22}$ arylalkyl; and $R_5$ is $C_1$-$C_6$ alkyl.

In some embodiments, $R_2$, $R_3$, and $R_4$ are independently $C_1$-$C_{22}$ alkyl.

In some embodiments, the substituted alkyl trialkyl quaternary ammonium salt is 3-chloro-2-hydroxypropyl-trimethylammonium chloride, 3-chloro-2-hydroxypropyl-dodecyl-dimethylammonium chloride, 3-chloro-2-hydroxypropyl-stearyl-dimethylammonium chloride, or any combination thereof.

In some embodiments, the polyamine is of formula (II):

(II)

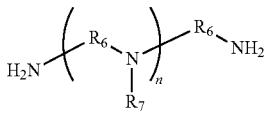

wherein n is an integer from 0 to 100; each $R_6$ is independently $C_2$-$C_6$ alkylene; and each $R_7$ is independently hydrogen or —$R_6$—$NH_2$, —$R_6$—NH—$R_6$—$NH_2$, or —$R_6$—N—($R_6$—$NH_2$)$_2$.

In some embodiments, the reaction product is of formula (III):

(III)

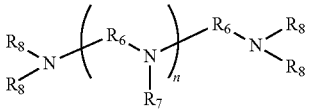

wherein each $R_6$ is independently $C_2$-$C_6$ alkylene; each $R_7$ is independently hydrogen, —$R_8$, —$R_6$—$N(R_8)_2$, —$R_6$—$N(R_8)$—$R_6$—$N(R_8)_2$, or —$R_6$—N—$(R_6$—$N(R_8)_2)_2$; each $R_8$ is independently hydrogen or

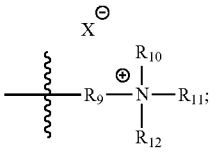

each $R_9$ is independently $C_2$-$C_6$ alkylene substituted with hydroxyl or —$OR_{13}$; $R_{10}$, $R_{11}$, and $R_{12}$ are each independently $C_1$-$C_{22}$ alkyl or $C_7$-$C_{22}$ arylalkyl; $R_{13}$ is $C_1$-$C_6$ alkyl; n is an integer from 1 to 100; and each $X^-$ is independently an anion.

In some embodiments, $R_6$ is ethyl.

In some embodiments, the reaction product may be from the reaction of a polyethylenimine and the substituted alkyl trialkyl quaternary ammonium salt of formula (I).

In some embodiments, the adhesive agent may be selected from polyaminoamide-epichlorohydrin (PAE) resins, polyamine-epichlorohydrin resins, polyvinyl alcohols, polyvinyl acetates, polyacrylamides, polyamines, hydrolyzed N-vinylformamide polymers, polyamides, polyvinylpyrrolidones, polyethers, polyethyleneimines, crosslinked vinyl alcohol copolymers, starch, guar gum, carboxymethyl cellulose, hydroxyethyl cellulose, hydroxypropyl cellulose, and any combination thereof.

In some embodiments, the composition may include a modifying agent.

In some embodiments, the modifying agent may be selected from glycerol, diglycerol, triglycerol, polyglycerol, and any combination thereof.

In some embodiments, the composition comprises about 0.01% to about 95% by weight of the release aid.

A Yankee dryer coating is disclosed that may include a release aid comprising a cationic polymer salt comprising a reaction product of a polyamine or a polyalkyleneimine and a substituted alkyl trialkyl quaternary ammonium salt of formula (I):

(I)

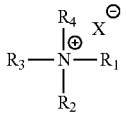

wherein each $X^-$ is independently an anion; $R_1$ is $C_1$-$C_6$ alkylene substituted with hydroxyl or —$OR_5$ and an $X^-$ end group; $R_2$, $R_3$, and $R_4$ are each independently $C_1$-$C_{22}$ alkyl or $C_7$-$C_{22}$ arylalkyl; and $R_5$ is $C_1$-$C_6$ alkyl.

In some embodiments, the Yankee dryer coating comprises about 0.01% to about 95% by weight of the release aid.

A method of creping a paper web is disclosed. The method may include applying to a creping cylinder any composition described herein; pressing the paper web against the creping cylinder to effect adhesion of the paper web to the creping cylinder; and dislodging the paper web from the creping cylinder with a doctor blade.

A method of treating paper is disclosed. The method may include adding a cationic polymer salt to cellulose fibers, the cationic polymer salt comprising a reaction product of a polyamine or a polyalkyleneimine and a substituted alkyl trialkyl quaternary ammonium salt of formula (I):

(I)

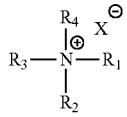

wherein each $X^-$ is independently an anion; $R_1$ is $C_1$-$C_6$ alkylene substituted with hydroxyl or —$OR_5$ and an $X^-$ end group; $R_2$, $R_3$, and $R_4$ are each independently $C_1$-$C_{22}$ alkyl or $C_7$-$C_{22}$ arylalkyl; and $R_5$ is $C_1$-$C_6$ alkyl.

In some embodiments, the cationic polymer salt may be added to the cellulose fibers in a wet-end of a papermaking machine or the cationic polymer salt may be added to cellulose fibers by spraying the cationic polymer salt onto a sheet comprising the cellulose fibers after the paper sheet is formed.

A use of any composition described herein for creping a paper web is also provided.

The foregoing has outlined rather broadly the features and technical advantages of the present disclosure in order that the detailed description that follows may be better understood. Additional features and advantages of the disclosure will be described hereinafter that form the subject of the claims of this application. It should be appreciated by those skilled in the art that the conception and the specific embodiments disclosed may be readily utilized as a basis for modifying or designing other embodiments for carrying out the same purposes of the present disclosure. It should also be realized by those skilled in the art that such equivalent embodiments do not depart from the spirit and scope of the disclosure as set forth in the appended claims.

BRIEF DESCRIPTION OF THE DRAWINGS

A detailed description of the invention is hereafter described with specific reference being made to the drawings in which:

FIG. 1 shows a graph of surface-tension (mN/m) vs. concentration (wt %) of various quaternary cationic surfactants.

DETAILED DESCRIPTION

Various embodiments are described below. The relationship and functioning of the various elements of the embodiments may better be understood by reference to the following detailed description. The embodiments, however, are not limited to those illustrated in the drawings and described herein. It should be understood that in certain instances details may have been omitted that are not necessary for an understanding of embodiments disclosed herein, such as—for example—conventional chemical synthesis and purification.

Unless otherwise defined, all technical and scientific terms used herein have the same meaning as commonly understood by one of ordinary skill in the art. In case of conflict, the present document, including definitions, will control. Preferred methods and materials are described below, although methods and materials similar or equivalent to those described herein can be used in practice or testing of the present invention. All publications, patent applications, patents and other references mentioned herein are incorporated by reference in their entirety. The materials, methods, and examples disclosed herein are illustrative only, and not intended to be limiting.

This disclosure generally relates to compositions of quaternary cationic compounds, and more particularly to compositions for use in papermaking applications. Compositions and coatings containing quaternary cationic compounds are disclosed in addition to methods of creping a paper web and treating paper.

A composition is provided that may include a release aid. The use of a composition containing a release aid for creping a paper web is also provided.

A Yankee dryer coating is also provided. The coating may include a release aid.

The composition or coating may include an adhesive agent. Examples of adhesive agents include, but are not limited to polyaminoamide-epichlorohydrin (PAE) resins, polyamine-epichlorohydrin resins, polyvinyl alcohols, polyvinyl acetates, polyacrylamides, polyamines, hydrolyzed N-vinylformamide polymers, polyamides, polyvinylpyrrolidones, polyethers, polyethyleneimines, crosslinked vinyl alcohol copolymers, starch, guar gum, carboxymethyl cellulose, hydroxyethyl cellulose, hydroxypropyl cellulose, or any combination thereof. In some embodiments, the adhesive agent is non-crosslinking PAE. Non-crosslinking PAE does not further crosslink when used as an adhesive agent. The molecular weight of the non-crosslinking PAE can be about 1.0 to about 1.5 million Daltons.

The composition or coating may include from about 0.01% to about 95.0% by weight of the adhesive agent. In some embodiments, the composition or coating may include from about 0.05% to about 5.0% by weight or from about 0.01% to about 10.0% by weight of the adhesive agent. In some embodiments, the composition or coating may include from about 0.1% to about 1.0% by weight of the adhesive agent.

The composition or coating may include a modifying agent. The modifying agent plasticizes the coating, keeping it soft, and allowing it to become rewetted and to maintain the adhesion while in the presence of high temperature. Examples of modifying agents include, but are not limited to glycerol, diglycerol, triglycerol, polyglycerol, or any combination thereof.

The composition or coating may include from about 0.01% to about 10.0% by weight of the modifying agent. In some embodiments, the composition or coating may include from about 0.05% to about 5.0% by weight of the modifying agent. In some embodiments, the composition or coating may include from about 0.1% to about 1.0% by weight of the modifying agent.

The composition may include a carrier. The carrier may be an aqueous carrier. The Yankee dryer coating may also include a carrier as the coating is applied onto the surface of a Yankee dryer. The carrier in the coating may evaporate from the coating due to the heat from the surface of the Yankee dryer. A suitable carriers can include, but is not limited to water.

The composition or coating may include about 0.01% to about 95% by weight of the release aid. In some embodiments, the amount of release aid in the composition or coating may be from about 0.01% to about 80% by weight, from about 0.01% to about 70% by weight, from about 0.01% to about 60% by weight, from about 0.01% to about 50% by weight, from about 0.01% to about 40% by weight, from about 0.01% to about 30% by weight, from about 0.01% to about 20% by weight, from about 0.01% to about 10% by weight, or from about 0.01% to about 5% by weight.

The composition or coating may include functional additives used in the art to improve the softness of the tissue or towel. Representative functional additives include dialkyl imidazolinium quaternary salts, dialkyl diamidoamine quaternary salts, monoalkyl trimethylanimonium quaternary salts, dialkyl dimethylanimonium quaternary salts, trialkyl monomethylammonium quaternary salts, ethoxylated quaternary salts, dialkyl and trialkyl ester quaternary salts, and the like. Additional suitable functional additives include polysiloxanes, quaternary silicones, organoreactive polysiloxanes, amino-functional polydimethylsiloxanes, and the like. In some embodiments, the functional additives are selected from dialkylimidazolinium quaternary salts and quaternary silicones.

The composition or coating may include an additional release aid. Representative additional release aids include release oils composed of naphthenic, paraffinic, vegetable, mineral or synthetic oil and emulsifying surfactants.

The composition or coating may include an additional surfactant. Suitable surfactants include, but are not limited to, anionic surfactants and nonionic surfactants. Anionic surfactants include alkyl aryl sulfonates, olefin sulfonates, paraffin sulfonates, alcohol sulfates, alcohol ether sulfates, alkyl carboxylates and alkyl ether carboxylates, and alkyl and ethoxylated alkyl phosphate esters, and mono and dialkyl sulfosuccinates and sulfosuccinamates. Nonionic surfactants include alcohol alkoxylates, alkylphenol alkoxylates, block copolymers of ethylene, propylene and butylene oxides, alkyl dimethyl amine oxides, alkyl-bis(2-hydroxyethyl) amine oxides, alkyl amidopropyl dimethyl amine oxides, alkylamidopropyl-bis(2-hydroxyethyl) amine oxides, alkyl polyglucosides, polyalkoxylated glycerides, sorbitan esters and polyalkoxylated sorbitan esters, and alkoyl polyethylene glycol esters and diesters. Also included are betaines and sultanes, amphoteric surfactants such as alkyl amphoacetates and amphodiacetates, alkyl amphopropionates and amphodipropionates, and alkyliminodipropionate.

The composition or coating may include from about 0.1 to about 20 wt. %, from about 0.5 to about 12 wt. %, or from about 0.5 to about 6 wt. % of a surfactant, based on total weight of the composition.

The composition coating may include a fluorescent tracing agent. This allows for the determination of whether and how much of the composition coats the creping cylinder. A suitable inert fluorescent tracer include, but are not limited to, 1,5-naphthalenedisulfonic acid disodium salt (1,5-65 NDSA), 2-amino-1-naphthalenesulfonic acid, 5-amino-2-naphthalenesulfonic acid, 4-amino-3-hydroxyl-1-naphthalenesulfonic acid, 6-amino-4-hydroxyl-2-naphthalenesulfonic acid, 7-amino-1,3-naphthalenedisulfonic acid, potassium salt, 4-amino-5-hydroxy-2, 7-naphthalenedisulfonic acid, 5-dimethylamino-1-naphthalenesulfonic acid, 2,6-naphthalenedicarboxylic acid, dipotassium salt, 2-anthracene-sulfonic acid, sodium salt, quinoline, 1-ethylquinaldinium iodide, dibenzofuransulfonic acid, BrilliantAcidYellow 8G 2, Lissamine Yellow FF, Acid Yellow 7), cresyl violet acetate, Safranine O, bathophenanthrolinedisulfonic acid disodium salt, Titan Yellow, Celestine Blue, and the like.

A method of creping a paper web is provided. The method may include applying to a creping cylinder a composition comprising a release aid, where the release aid may include a cationic polymer salt. The method may include pressing the paper web against the creping cylinder to effect adhesion of the paper web to the creping cylinder and dislodging the paper web from the creping cylinder with a doctor blade.

"Doctor blade" means a blade that is disposed adjacent to another piece of equipment such that the doctor blade can help remove from that piece of equipment a material that is disposed thereon. Doctor blades are commonly used in many different industries for many different purposes, such as, for example, their use to help remove material from a piece of equipment during a process. Examples of materials include, but are not limited to, tissue webs, paper webs, glue, residual buildup, pitch, and combinations thereof. Examples of equipment include, but are not limited to, drums, plates, Yankee dryers, and rolls. Doctor blades are commonly used in paper-making, nonwovens manufacture, the tobacco industry, and in printing, coating and adhesives processes. In certain instances, doctor blades are referred to by names that reflect at least one of the purposes for which the blade is being used.

The composition that can be applied to the creping cylinder can be any composition described herein. The composition applied to the creping cylinder may include an adhesive agent. In some embodiments, the release aid and the adhesive agent can be applied separately to the creping cylinder. The release aid may be applied to the creping cylinder before or after the adhesive agent, or may be formulated with the adhesive agent for application to the creping cylinder. Typically the adhesive agent and release aid are fed in neat form from separate containers, then mixed in line with additional dilution water for spray application to the creping cylinder.

The composition may be applied to the surface of a creping cylinder as an aqueous solution. Those skilled in the art of coating creping cylinders will appreciate that the reason for such a larger percentage of water in the admixture is in part based on the need to only deposit a very thin layer of the composition on the creping cylinder. The composition can be applied using a spray boom.

A variety of spraying schemes can be used to apply the composition to the surface of the creping cylinder, for example by using spray booms designed for double or triple coverage, by oscillating the spray boom and by recirculation of the composition from the outlet of the spray boom to improve mixing and reduce the possibility of separation.

A method of treating paper is provided. The method may include adding a cationic polymer salt to cellulose fibers. Without being bound by any particular theory, the cationic polymer salts functions as a debonding and surface lubricity agent when added to the cellulose fibers. The cationic polymer salts disclosed herein can be used to soften paper products by de-bonding its cellulose fibers and by improving the smoothness of the resulting paper.

In some embodiments, the cationic polymer salt may be added to the cellulose fibers in a wet-end of a papermaking machine. Alternatively, the cationic polymer salt may be added to cellulose fibers by spraying the cationic polymer salt onto a sheet comprising the cellulose fibers after the paper sheet is formed.

The method of treating paper may also include adding a surfactant, such as a nonionic surfactant to the cellulose fibers. Examples of suitable nonionic surfactants include, but are not limited to, alkanolamides, alkoxylated alcohols, amine oxides, ethoxylated amines, alkoxy-lated amides, EO-PO-block copolymers, alkoxylated fatty alcohols, alkoxylated fatty acid esters, alkylarylalkoxylates, sorbitan derivatives, polyglyceryl fatty acid esters, alkyl (poly)glucosides, fluorocarbon-based surfactants, or any combination thereof.

A softening compound can also be applied to the cellulose fibers. The cationic polymer salt or any other additional component (surfactant or softening compound) can be applied to the cellulose fibers by means of spraying. The softening compound can be printed on the paper or through a heated transfer surface.

The cellulose fibers may be used to make a paper product or paper sheet. "Paper product or paper sheet" means any formed fibrous structure end product of a papermaking process traditionally, but not necessarily, comprising cellulose fibers. Examples of such end products include but are not limited to facial tissue, bath tissue, table napkins, paper towels, wipers, copy paper, printer paper, writing paper, notebook paper, newspaper, paper board, poster paper, bond paper, cardboard, and the like.

"Papermaking Process" means one or more processes for converting raw materials into paper products and which includes but is not limited one or more of such steps as pulping, digesting, refining, drying, calandering, pressing, creping, dewatering, and bleaching.

The release aid may include a cationic polymer salt. The release aid reduces the strength of the adhesive to allow a doctor blade to remove the dried paper mat from the drum.

The cationic polymer salt may be a reaction product of a polyamine or a polyalkyleneimine and a substituted alkyl trialkyl quaternary ammonium salt of formula (I):

(I)

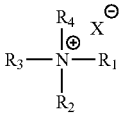

wherein each $X^-$ is independently an anion; $R_1$ is $C_1$-$C_6$ alkylene substituted with hydroxyl or —$OR_5$ and an $X^-$ end group; $R_2$, $R_3$, and $R_4$ are each independently $C_1$-$C_{22}$ alkyl or $C_7$-$C_{22}$ arylalkyl; and $R_5$ is $C_1$-$C_6$ alkyl.

Unless otherwise indicated, an "alkyl" group as described herein alone or as part of another group is an optionally substituted linear saturated monovalent hydrocarbon radical containing from one to thirty two carbon atoms, or an optionally substituted branched saturated monovalent hydrocarbon radical containing three to thirty-two carbon atoms. Examples of unsubstituted alkyl groups include methyl, ethyl, n-propyl, i-propyl, n-butyl, i-butyl, s-butyl, t-butyl, n-pentyl, i-pentyl, s-pentyl, t-pentyl, and the like. Alkyl groups can be unsubstituted or substituted by one or more suitable substituents, as defined below. Preferably, the substitutions are not within the main chain or backbone of the polymer salt.

"Arylalkyl" means an aryl group attached to the parent molecule through an alkylene group. The number of carbon atoms in the aryl group and the alkylene group is selected such that there is a total of about 7 to about 22 carbon atoms in the arylalkyl group. A preferred arylalkyl group is benzyl.

The term "-ene" as used as a suffix as part of another group denotes a bivalent radical in which a hydrogen atom is removed from each of two terminal carbons of the group. For example, alkylene denotes a bivalent alkyl group such as methylene (—$CH_2$—) or ethylene (—$CH_2CH_2$—). For clarity, addition of the -ene suffix is not intended to alter the definition of the principal word other than denoting a bivalent radical. Thus, continuing the example above, alkylene denotes an optionally substituted linear saturated bivalent hydrocarbon radical.

The term "suitable substituent," as used herein, is intended to mean a chemically acceptable functional group that does not negate the activity of the inventive compounds. Such suitable substituents include, but are not limited to halo groups, perfluoroalkyl groups, perfluoroalkoxy groups, alkyl groups, alkenyl groups, alkynyl groups, hydroxy groups, oxo groups, mercapto groups, alkylthio groups, alkoxy groups, aryl or heteroaryl groups, aryloxy or heteroaryloxy groups, arylalkyl or heteroarylalkyl groups, arylalkoxy or heteroarylalkoxy groups, carboxyl groups, heterocyclic groups, cycloalkyl groups, amino groups, alkyl- and dialkylamino groups, carbamoyl groups, alkylcarbonyl groups, alkoxycarbonyl groups, alkylaminocarbonyl groups, dialkylamino carbonyl groups, arylcarbonyl groups, aryloxycarbonyl groups, alkylsulfonyl groups, and arylsulfonyl groups. Those skilled in the art will appreciate that many substituents can be substituted by additional substituents.

Suitable $X^-$ anions can include, but are not limited to, chloride, bromide, fluoride, iodide, acetate, aluminate, cyanate, cyanide, dihydrogen phosphate, dihydrogen phosphite, formate, hydrogen carbonate, hydrogen oxalate, hydrogen sulfate, hydroxide, metaniobate, metavanadate, nitrate, nitrite, thiocyanate, or a combination thereof. In some embodiments, the anion can comprise chloride or bromide.

$R_2$, $R_3$, and $R_4$ can be independently $C_1$-$C_{22}$ alkyl. In some embodiments, $R_2$, $R_3$, and $R_4$ can all be methyl. Alternatively, $R_2$ can be $C_6$-$C_{22}$ alkyl or $C_7$-$C_{22}$ arylalkyl and $R_3$ and $R_4$ can be $C_1$-$C_4$ alkyl such as methyl, or $R_2$ and $R_3$ are $C_6$-$C_{22}$ alkyl or $C_7$-$C_{22}$ arylalkyl and $R_4$ is $C_1$-$C_4$ alkyl such as methyl.

Suitable substituted alkyl trialkyl quaternary ammonium salt monomers can include, but not limited to, 3-chloro-2-hydroxypropyl-trimethylammonium chloride; 3-chloro-2-hydroxypropyl-dodecyl-dimethylammonium chloride; 3-chloro-2-hydroxypropyl-stearyl-dimethylammonium chloride; or a combination thereof.

The polyamine can comprise a polymer of formula (II):

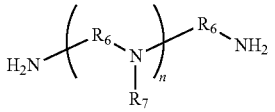

(II)

wherein n is an integer from 0 to 100; each $R_6$ is independently $C_2$-$C_6$ alkylene; and each $R_7$ is independently hydrogen or —$R_6$—$NH_2$, —$R_6$—NH—$R_6$—$NH_2$, or —$R_6$—N—$(R_6—NH_2)_2$.

In the polyamine of formula (II), n can be from 0 to 90, 0 to 80, 0 to 70, 0 to 60, 0 to 50, 0 to 45, 0 to 40, 0 to 35, 0 to 30, 0 to 25, 0 to 20, 0 to 15, 0 to 10, 0 to 9, 0 to 8, 0 to 7, 0 to 6, 0 to 5, 1 to 90, 1 to 80, 1 to 70, 1 to 60, 1 to 50, 1 to 45, 1 to 40, 1 to 35, 1 to 30, 1 to 25, 1 to 20, 1 to 15, 1 to 10, 1 to 9, 1 to 8, 1 to 7, to 6, 1 to 5. In some embodiments, n may be from 2 to 5, 2 to 6, 2 to 7, 2 to 8, 2 to 9, 2 to 10, 2 to 25, 2 to 30, 2 to 35, 2 to 40, 2 to 45, 2 to 90, or any sub-range thereof. In other embodiments, n may be from 3 to 100, 3 to 90, 3 to 80, 3 to 70, 3 to 60, 3 to 50, 3 to 45, 3 to 40, 3 to 35, 3 to 30, 3 to 25, 3 to 10, or any sub-range thereof. In certain embodiments, n is selected from 1, 2, 3, 4, 5, 6, 7, 8, 9, or 10.

In the polyamine of formula (II), $R_6$ can be $C_2$-$C_3$ alkyl. In some embodiments, $R_6$ can be ethyl.

In the polyamine of formula (II), none of the nitrogens of the polyamine need be quaternized.

Suitable polyamines can include an alkyleneamine. The alkyleneamine can comprise, but is not limited to, ethylenediamine, diethylenetriamine, triethylenetetraamine, diethylenetriamine, triethylenetetramine, tetraethylenepentamine, pentaethylenehexamine, hexaethyleneheptamine, or a combination thereof.

Suitable polyalkyleneimines can include, but are not limited to, ethyleneimine, propyleneimine, butyleneimine, pentyleneimine, hexyleneimine, heptyleneimine, or a combination thereof.

Suitable polyalkyleneimines can include, but are not limited to, branched, linear, or dendrimer polyethyleneimines.

In some embodiments, the weight average molecular weight of the linear, branched, or dendrimer polyethyleneimine, as measured by gel permeation chromatography, may range from about 200 gm/mol to about 750,000 gm/mol. In some embodiments, the weight average molecular weight of the polymeric salt may be about 800 gm/mol, about 1,300 gm/mol, about 2,000 gm/mol, about 5,000 gm/mol, about 20,000 gm/mol, about 25,000 gm/mol, or about 750,000 gm/mol.

In some embodiments, the viscosity of the linear, branched, or dendrimer polyethyleneimine, as measured according to ISO 2555 on a Brookfield viscometer, may range from about 100 mPa s to about 30,000 mPa s. In some embodiments, the viscosity of the linear, branched, or dendrimer polyethyleneimine, may range from about 200 mPa s to about 15,000 mPa s or from about 200 mPa s to about 500 mPa s. In some embodiments, the viscosity of the linear, branched, or dendrimer polyethyleneimine, may be about 300 mPa s, about 400 mPa s, about 500 mPa s, about 600 mPa s, or about 1000 mPa s.

In some embodiments, the ratio of the primary amine/secondary amine/tertiary amine in the polyethyleneimine may be about 1/0.9/0.6 as measured by $^{13}$CNMR. The amount of amine in the dry polyethyleneimine may range from about 10 mmol/gm to about 30 mmol/gm. The amount of amine in the polyethyleneimine may be about 12 mmol/gm, about 13 mmol/gm, about 14 mmol/gm, about 15 mmol/gm, about 16 mmol/gm, about 17 mmol/gm, about 18 mmol/gm, about 19 mmol/gm, about 20 mmol/gm, about 21 mmol/gm, or about 22 mmol/gm.

The molar ratio of the polyamine or polyalkyleneimine to the substituted alkyl trialkyl quaternary ammonium salt as reactants can range from 1:1 to 1:100, 1:1 to 1:90, 1:1 to 1:80, 1:1 to 1:70, 1:1 to 1:60, 1:1 to 1:50, 1:1 to 1:45, 1:1 to 1:40, 1:1 to 1:35, 1:1 to 1:30, 1:1 to 1:25, 1:1 to 1:20, 1:1 to 1:15, 1:1 to 1:10, 1:1 to 1:9, 1:1 to 1:8, 1:1 to 1:7, 1:1 to 1:6, 1:1 to 1:5, 1:1 to 1:4, 1:1 to 1:3, or 1:1 to 1:2.

In some embodiments, a cationic polymer salt may be a reaction product of a polyamine, an alkyleneimine, or a polyalkyleneimine and the substituted alkyl trialkyl quaternary ammonium salt of formula (I) as described above, and wherein any one of the following:

(A) the cationic polymer salt has no substitutions within its main chain, no alkyl-quaternized ammonium within its main chain, and comprises at least 4 quaternary ammonium groups; or (B) the cationic polymer salt has one or more terminal tertiary amine groups having the formula (IV):

(IV)

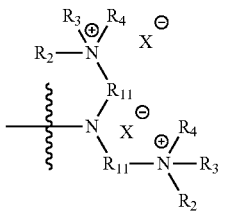

wherein $R_{11}$ is $R_1$ without the $X^-$ end group, and either: the polymer salt has no substitutions within its main chain or at least 1 of $R_2$, $R_3$, and $R_4$ is a $C_9$-$C_{22}$ alkyl group; or (C) $R_2$ and $R_3$ of formula (I) are $C_6$-$C_{22}$ alkyl or $C_7$-$C_{22}$ arylalkyl and $R_4$ is methyl.

In some embodiments, the cationic polymer salt can include a reaction product of formula (III):

(III)

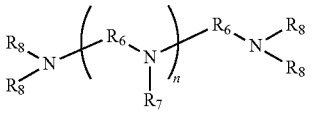

wherein each $R_6$ is independently $C_2$-$C_6$ alkylene; each $R_7$ is independently hydrogen, —$R_8$, —$R_6$—$N(R_8)_2$, —$R_6$—$N(R_8)$—$R_6$—$N(R_8)_2$, or —$R_6$—N—($R_6$—$N(R_8)_2)_2$; each $R_8$ is independently hydrogen or

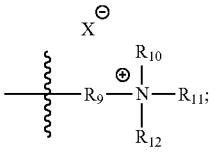

each $R_9$ is independently $C_2$-$C_6$ alkylene substituted with hydroxyl or —$OR_{13}$; $R_{10}$, $R_{11}$, and $R_{12}$ are each independently $C_1$-$C_{22}$ alkyl or $C_7$-$C_{22}$ arylalkyl; $R_{13}$ is $C_1$-$C_6$ alkyl; n is an integer from 1 to 100; and each $X^-$ is independently an anion.

In some embodiments, a cationic polymer salt may be of formula (V):

(V)

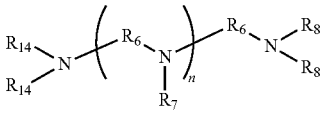

wherein $R_6$, $R_7$, $R_8$, $R_9$, $R_{10}$, $R_{11}$, $R_{12}$, $R_{13}$, n, and $X^-$ are as defined for formula (III) above, $R_{14}$ is

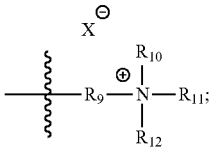

and wherein one of the following:

(a) the polymer salt has no substitutions within its main chain, no alkyl-quaternized ammonium within its main chain, and comprises at least 4 quaternary ammonium groups; or (b) either: the polymer salt has no substitutions within its main chain or at least 1 of $R_{10}$, $R_{11}$, and $R_{12}$ of $R_{14}$ is a $C_9$-$C_{22}$ alkyl group; or (c) the polymer salt includes at least 3 of $R_{12}$ wherein $R_{12}$ is $C_9$-$C_{15}$ alkyl; or (d) the polymer salt includes at least 3 of $R_{12}$ wherein $R_{12}$ is $C_{15}$-$C_{22}$ alkyl.

In the cationic polymer salt of formula (III) or (V), n can be from 1 to 90, 1 to 80, 1 to 70, 1 to 60, 1 to 50, 1 to 45, 1 to 40, 1 to 35, 1 to 30, 1 to 25, or any sub-range thereof. In some embodiments, n may be from 2 to 25, 2 to 30, 2 to 35, 2 to 40, 2 to 45, 2 to 90, or any sub-range thereof. In other embodiments, n may be from 3 to 100, 3 to 90, 3 to 80, 3 to 70, 3 to 60, 3 to 50, 3 to 45, 3 to 40, 3 to 35, 3 to 30, 3 to 25, or any sub-range thereof. In certain embodiments, n is selected from 1, 2, 3, 4, 5, 6, 7, 8, 9, or 10.

In the cationic polymer salt of formula (III) or (V), each $R_6$ and $R_9$ can be independently $C_2$-$C_3$ alkylene. In some embodiments, each $R_6$ can be ethylene.

In the cationic polymer salt of formula (III), each $R_9$ can be hydroxypropylene; $R_{10}$ and $R_{11}$ can be methyl; and each $R_{12}$ can be independently methyl or $C_5$-$C_{22}$ alkyl. In some embodiments, at least one $R_{12}$ is $C_1$-$C_{22}$ alkyl.

In other embodiments of the cationic polymer salt of formula (III), $R_7$ is —$R_8$, —$R_6$—$N(R_8)_2$, —$R_6$—$N(R_8)$—$R_6$—$N(R_8)_2$, or —$R_6$—N—($R_6$—$N(R_8)_2)_2$; each $R_8$ is

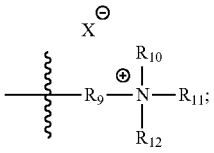

each $R_9$ is independently $C_2$-$C_6$ alkylene substituted with hydroxyl or —$OR_{13}$; $R_{10}$, $R_{11}$, and $R_{12}$ are each independently $C_1$-$C_{22}$ alkyl or $C_7$-$C_{22}$ arylalkyl; $R_{13}$ is $C_1$-$C_6$ alkyl; n is an integer from 1 to 100; and each $X^-$ is independently an anion.

In some embodiments of the polymer salt of formula (III), at least one of $R_{12}$ may be a saturated $C_9$-$C_{15}$ alkyl group. The saturated alkyl group may range from $C_{10}$ to $C_{15}$, $C_{11}$ to $C_{15}$, $C_{12}$ to $C_{15}$, $C_{12}$ to $C_{14}$, $C_{11}$ to $C_{14}$, $C_{10}$ to $C_{14}$, $C_9$ to $C_{14}$, $C_9$ to $C_{13}$, $C_{10}$ to $C_{13}$, or $C_{11}$ to $C_{13}$. In other embodiments at least 2, 3, 4, or 5 of $R_{12}$ may be a saturated $C_9$-$C_{15}$ alkyl group. For instance, at least one of $R_{12}$ may be a $C_{12}$ alkyl group, or, at least 2, 3, 4, or 5 of $R_{12}$ may be a $C_{12}$ alkyl group.

In other embodiments of the polymer salt of formula (III), at least one of $R_{12}$ may be a saturated $C_{15}$-$C_{22}$ alkyl group. The saturated alkyl group may range from $C_{16}$ to $C_{22}$, $C_{17}$ to $C_{21}$, $C_{16}$ to $C_{20}$, $C_{18}$ to $C_{22}$, $C_{16}$ to $C_{18}$, $C_{15}$ to $C_{18}$, $C_{15}$ to $C_{20}$, or $C_{17}$ to $C_{19}$. In other embodiments, at least 2, 3, 4, or 5 of $R_{12}$ may be a saturated $C_{15}$-$C_{22}$ alkyl group.

In other embodiments, at least one of $R_{12}$ may be a saturated $C_{12}$ alkyl group. In still further embodiments, at least 2, 3, 4, or 5 of $R_{12}$ may be a saturated $C_{12}$ alkyl group.

In other embodiments, at least one of $R_{12}$ may be a saturated $C_{18}$ alkyl group. In still further embodiments, at least 2, 3, 4, or 5 of $R_{12}$ may be a saturated $C_{18}$ alkyl group.

In some embodiments of the polymer salt of formula (III), at least one $R_9$ can be $R_8$, or at least two, three or four $R_9$ can be $R_8$. In some embodiments, the cationic salt of formula (III) may comprise at least three substituted alkyl trialkyl quaternary ammonium groups. In other embodiments, there may be at least four, five, or six quaternary ammonium groups. In some embodiments, the quaternary ammonium groups may not be in the main chain or backbone of the polymer salt, but only on the branches or side-chains.

In any of the cationic polymer salts as described herein, the polymer salt may or may not have any alkyl-quaternary ammoniums within the main chain of the polymer salt. For example, the polymer salt may not have any —$N(CH_3)(CH_3)$— nitrogens within the main chain of the polymer salt.

The preparation of cationic polymer salts can be conducted conveniently by reacting a polyamine or a polyalkyleneimine or any combination thereof with a substituted alkyl trialkyl quaternary ammonium salt at a pH of at least about 7.5 to form the polymer salt. The molar ratio of the polyamine or polyalkyleneimine to the substituted alkyl trialkyl quaternary ammonium salt as reactants can range from 1:1 to 1:100, 1:1 to 1:90, 1:1 to 1:80, 1:1 to 1:70, 1:1 to 1:60, 1:1 to 1:50, 1:1 to 1:45, 1:1 to 1:40, 1:1 to 1:35, 1:1 to 1:30, 1:1 to 1:25, 1:1 to 1:20, 1:1 to 1:15, 1:1 to 1:10, 1:1 to 1:9, 1:1 to 1:8, 1:1 to 1:7, 1:1 to 1:6, 1:1 to 1:5, 1:1 to 1:4, 1:1 to 1:3, or 1:1 to 1:2. The reaction mixture can be stirred and heated to about 50-100° C. for about 2 to 6 hours. A base can be added to maintain a pH of at least about 7.5. For example, the reactants can be added to an aqueous solution in a reactor while monitoring the pH of the aqueous solution until the completion of reaction, and adjusting the pH of the aqueous medium to maintain the pH value of the aqueous solution equal to or greater than about 7.5.

For example, an alkyleneamine such as diethylenetriamine and a substituted alkyltrialkyl quaternary ammonium salt such as 3-chloro-2-hydroxypropyl trimethylammonium chloride can be added to a reaction container equipped with a mechanical stirrer, a thermometer, a temperature controller, a condenser, and an addition funnel. The reaction mixture is stirred and gently heated to about 60° C. The pH value of the reaction is continuously monitored. A base such as sodium hydroxide (50% aqueous solution) is slowly added to the reaction container and the temperature is held constant at about 60° C. The pH value of reaction solution is measured and held constant above about 7.5. The reaction temperature is raised to about 85° C. and held constant for about 5 hours.

As another example, a polyalkyleneimine such as polyethyleneimine and a substituted alkyltrialkyl quaternary ammonium salt such as 3-chloro-2-hydroxypropyl trimethylammonium chloride can be added to a reaction container equipped with a mechanical stirrer, a thermometer, a temperature controller, a condenser, and an addition funnel. The reaction mixture is stirred and gently heated to about 60° C. The pH value of the reaction is continuously monitored. A base such as sodium hydroxide (50% aqueous solution) is slowly added to the reaction container and the temperature is held constant at about 60° C. The pH value of reaction solution is measured and held constant above about 7.5. The reaction temperature is raised to about 85° C. and held constant for about 5 hours.

The polymer salts described herein are generally random polymers wherein the exact order of the structural units derived from the polyamine, polyalkyleneimine and substituted alkyl trialkyl quaternary ammonium salt is not predetermined.

The polymer salt is generally a reaction product of a mixture that may also contain components that are not chemically incorporated into the polymer. For those reaction products that contain additional components in the mixture that are not intended to be incorporated into the polymer, such additional components typically comprise solvents, pH adjusting agents, buffers, and/or other components known to those of skill in the art.

In some embodiments, the weight average molecular weight of the cationic polymeric salts described herein, as measured by gel permeation chromatography, may range from about 200 gm/mol to about 1,000,000 gm/mol. In some embodiments, the weight average molecular weight of the polymeric salt may be from about 500 gm/mol to about 100,000 gm/mol, from about 500 gm/mol to about 50,000 gm/mol, from about 500 gm/mol to about 40,000 gm/mol, from about 500 gm/mol to about 30,000 gm/mol, from about 5,000 gm/mol to about 30,000 gm/mol, from about 10,000 gm/mol to about 30,000 gm/mol, from about 500 gm/mol to about 20,000 gm/mol, from about 500 gm/mol to about 10,000 gm/mol, or from about 500 gm/mol to about 5,000 gm/mol.

In some embodiments, the cationic polymer salt may include a reaction product selected from the group consisting of:

Compound 1

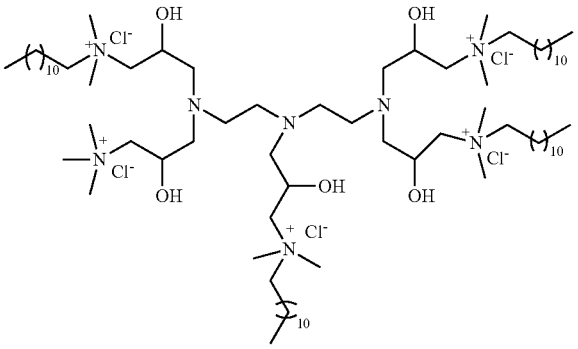

Compound 3

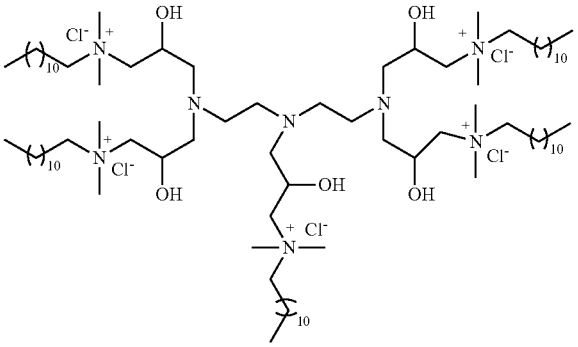

-continued

Compound 7

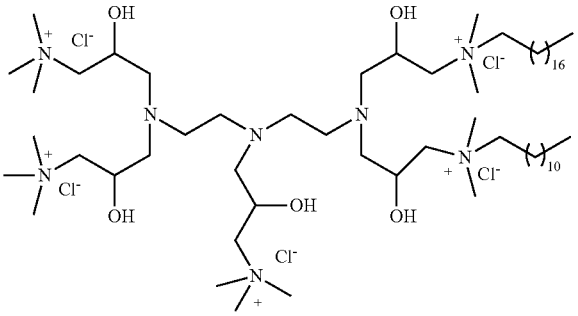

Compound 9

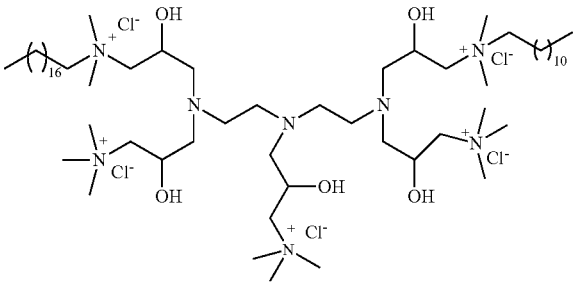

Compound 10

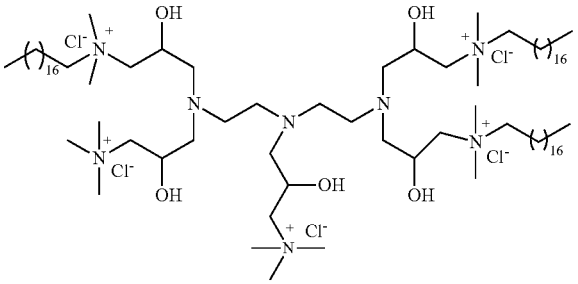

Compound 11

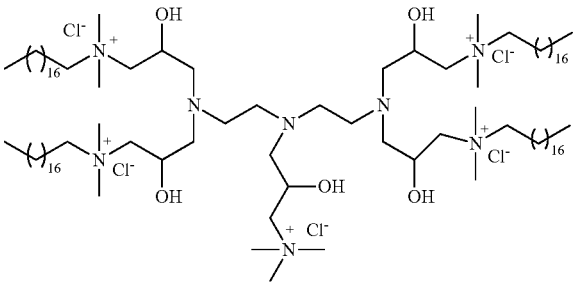

Compound 12

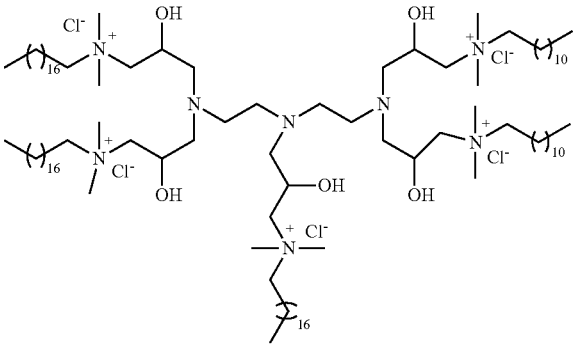

-continued

Compound 13

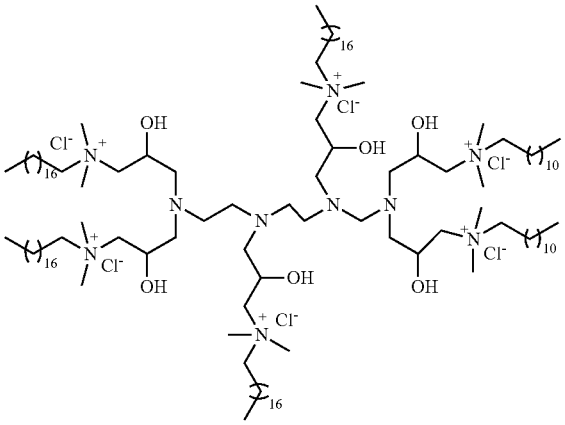

In certain embodiments, the cationic polymer salt is selected from Compound 1, Compound 2, Compound 3, Compound 4, Compound 5, Compound 6, Compound 7, Compound 8, Compound 9, Compound 10, Compound 11, Compound 12, Compound 13, or any combination thereof.

The cationic polymer salt may be a reaction product of a polyethylenimine and the substituted alkyl trialkyl quaternary ammonium salt of formula (I).

In certain embodiments, the cationic polymer salt is selected from Compound 14, Compound 15, or Compound 16.

EXAMPLES

The following non-limiting examples are provided to further illustrate various aspects of the present disclosure. All chemicals were used as received from the supplier unless otherwise noted.

NMR samples of the cationic polymer salts were prepared in $D_2O$. All spectra were acquired at 25° C. Quantitative proton ($^1H$) and carbon ($^{13}C$) were acquired using a single-pulse sequence implemented on an AGILENT 500 MHz spectrometer equipped with a 10 mm broad-band probe for carbon or a 5 mm two-channel probe for proton with Z-gradient. $^1H$ spectra were acquired with 4-8 scans. $^{13}C$ spectra were acquired with 400-500 scans. Data were processed and analyzed using MestReNova v. 9 (Mestrelab, Spain).

The chemical shifts (ppm) are reported relative to TMS (tetramethylsilane) using the residual solvent peak as reference unless otherwise noted. The following abbreviations are used to express the multiplicities: s=singlet; d=doublet; t=triplet; q=quartet; m=multiplet; br=broad.

Mass spectroscopy of the cationic surfactants was conducted on a Q EXACTIVE ORBITRAP high resolution mass spectrometer (Thermo Fisher Scientific) equipped with a quadrupole as an ion filter and with an electrospray ionization (ESI) source. Surfactant samples were diluted to about 100 ppm and then injected into the mass spectrometer by infusion at the flow rate of 10 μL/minute. Spectra were acquired in positive ESI mode; scan range: 50-750 m/z; resolution: 140 k; AGC target: $3^6$; sheath gas flow rate: 2 (arbitrary unit); auxiliary gas flow rate: 0 (arbitrary unit); spray voltage: 2.5 kV; capillary temperature: 150° C.; auxiliary gas heater temperature: 30° C.; and S-Len RF level:

50. Data were acquired and analyzed by XCALIBUR and FREESTYLE software (Thermo Fisher Scientific).

Example 1: Synthesis of Multiple Quaternary Cationic Surfactants with Methyl Groups Diethylenetriamine (DETA, 10.32 grams, 0.10 mol) and 3-chloro-2-hydroxypropyl trimethylammonium chloride (156.7 grams, 60.0%, 0.50 mol, (Sigma-Aldrich) were added to a 500 mL four-neck round bottom flask equipped with a mechanical stirrer, a thermometer, a temperature controller, a condenser, and an addition funnel. The reaction mixture was stirred and gently heated to 60° C. The pH value of the reaction was continuously monitored. Sodium hydroxide (50% aqueous solution) was slowly added to the reaction flask and the temperature was held constant at 60° C. The pH value of reaction solution was measured and was held constant above 7.5. The reaction temperature was raised to 85° C. and held constant for 5 hours. The reaction scheme is as follows wherein $R_1$, $R_2$ and $R_3$ are methyl and n is 1:

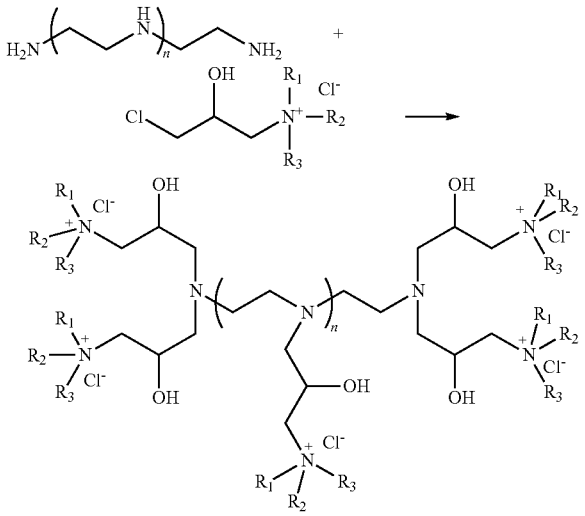

$^{13}C$ NMR (500 MHz, $D_2O$, 25° C.) spectra showed the chemical shifts at 44-46 ppm and 58-59.3 ppm which were assigned to the reacted DETA. The resonance signal at 47.5 ppm represents the chlorinated methylene in unreacted 3-chloro-2-hydroxypropyl trimethylammonium chloride. The total amount of 3-chloro-2-hydroxypropyl trimethylammonium chloride was determined based on the sharp signal at 54.5 ppm from the methyl groups. The average charge per DETA was 4.8, consistent with theoretical values of 5 charges. MS (ESI): calc. $[M-2Cl^-]^{2+}$ 394.275, found 394.278; calc. $[M-3Cl^-]^{3+}$ 251.193 found 251.195; calc. $[M-4Cl^-]^{4+}$ 179.655, found 179.654; calc. $[M-5Cl^-]^{5+}$ 136.73, found 136.73.

Example 2: Synthesis of Multiple Quaternary Cationic Surfactants with Lauryl Groups Multiple quaternary cationic surfactants with lauryl chains were synthesized by reacting diethylenetriamine (DETA) and 3-chloro-2-hydroxypropyl-dodecyl-dimethylammonium chloride (QUAB 342™ from Quab Chemicals, Saddle Brook, N.J.). Diethylenetriamine (5.16 grams, 0.05 mol) and 3-chloro-2-hydroxypropyl-dodecyl-dimethylammonium chloride (222.66 grams, 38.4 wt. %, 0.25 mol) were charged to a 500 mL four-neck round bottom flask equipped with a mechanical stirrer, a thermometer, a temperature controller, a condenser, and an addition funnel. The reaction mixture was stirred and gently heated to 60° C. The pH value of the reaction was continuously monitored. Sodium hydroxide (50% aqueous solution) was slowly added to the reaction flask and the temperature was held constant at 60° C. The pH value of reaction solution was measured and was held constant above 7.5. The reaction temperature was raised to 85° C. and held constant for 5 hours.

The mass spectroscopy data showed that the reaction product contained a mixture of 2 quaternary-2 dimethyl dodecyl ammonium chlorides (MS (ESI): calc. $[M-2Cl^-]^{2+}$ 321.83, found 321.83); 3 quaternary-3 dimethyl dodecyl ammonium chlorides (MS (ESI): calc. $[M-Cl^-]^+$ 983.89, found 983.89; calc. $[M-2Cl^-]^{2+}$ 474.46, found 474.46; 4 quaternary-4 dimethyl dodecyl ammonium chlorides (MS (ESI): calc. $[M-Cl^-]^+$ 1289.14, found 1289.13, calc. $[M-2Cl^-]^{2+}$ 627.08, found 627.08; calc. $[M-3Cl^-]^{3+}$ 406.40, found 406.40; calc. $[M-4Cl^-]^{4+}$ 296.06, found 296.06); and 5 quaternary-5 dimethyl dodecyl ammonium chlorides (MS (ESI): calc. $[M-2Cl^-]^{2+}$ 779.71, found 779.71; calc. $[M-3Cl^-]^{3+}$ 508.15, found 508.48; calc. $[M-4Cl^-]^{4+}$ 372.37, found 372.37). Surface tension, 63.63 mN/m at 0.050 wt % aqueous solution.

Example 3: Synthesis of Multiple Quaternary Cationic Surfactants with Different Alkyl Chains A five-quaternary cationic surfactant was synthesized by reacting diethylene triamine (DETA, 10.32 grams, 0.10 mol) and 3-chloro-2-hydroxypropyl trimethylammonium chloride (62.7 grams, 60.0% 0.20 0 mol) and 3-chloro-2-hydroxypropyl-dimethyldodecylammonium chloride (267.2 grams, 38.4 wt. %, 0.30 mol) (QUAB 342™) using the procedure described in Example 1.

Alternatively, the synthesis can be conducted using a mixture of 3-chloro-2-hydroxypropyl trimethylammonium chloride and 3-chloro-2-hydroxypropyldimethyloctadecylammonium chloride with different molar ratios; however a total of 5 moles of trialkylammonium chloride was held constant.

A six-quaternary cationic surfactant was synthesized by reacting triethylene tetraamine (TETA, 12.2 grams, 60 wt. %, 0.05 moles) and 3-chloro-2-hydroxypropyldimethyloctadecylammonium chloride (336.3 grams, 38.0%, 0.30 mol; QUAB 426™ from Quab Chemicals, Saddle Brook, N.J.) in propylene glycol (PP425, 69.9 grams) using the procedure described in Example 1.

It was determined that varying the solvents between a mixture of water/propanediol and water/propanediol/PP425 or water/hexylene glycol achieved a homogenous phase during the reaction. Further, it was found that propanediol and propylene glycol increased the water solubility of multiple cationic surfactants with long alkyl chains.

Compound 1 was synthesized using diethylenetriamine (1 mol), (3-chloro-2-hydroxypropyl) lauryl dimethylammonium chloride (4 mol), and (3-chloro-2-hydroxypropyl) trimethylammonium chloride (1 mol). Mass spectrometry confirmed synthesis of Compound 1: calc. $[M-2Cl^-]^{2+}$ 702.62, found 703.62; calc. $[M-3Cl^-]^{3+}$ 456.76, found 457.09.

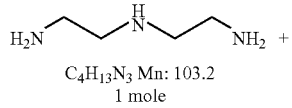

$C_4H_{13}N_3$ Mn: 103.2
1 mole

-continued

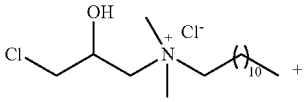

$C_{17}H_{37}Cl_2NO$ Mn: 342
4 moles

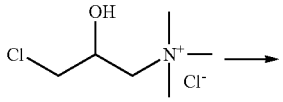

$C_6H_{15}Cl_2NO$ Mn: 188
1 moles

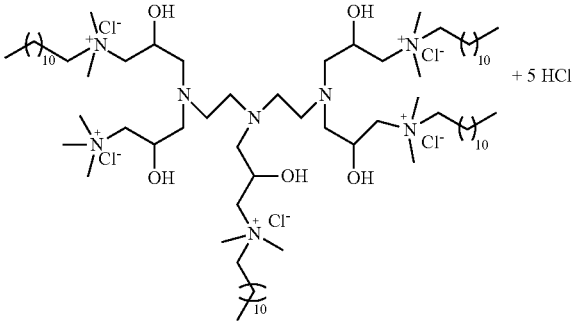

Compound 1

Compound 2 was synthesized using diethylenetriamine (1 mol), (3-chloro-2-hydroxypropyl) lauryl dimethylammonium chloride (3 mol), and (3-chloro-2-hydroxypropyl) trimethylammonium chloride (2 mol). Mass spectrometry confirmed synthesis of Compound 2: calc. $[M-2Cl^-]^{2+}$ 625.54, found 626.53; calc. $[M-3Cl^-]^{3+}$ 405.37, found 405.7; calc. $[M-4Cl^-]^{4+}$ 295.28, found 295.28.

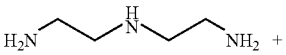

$C_4H_{13}N_3$ Mn: 103.2
1 mole

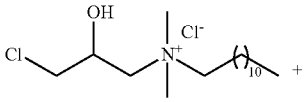

$C_{17}H_{37}Cl_2NO$ Mn: 342
3 moles

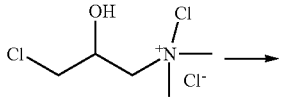

$C_6H_{15}Cl_2NO$ Mn: 188
2 moles

-continued

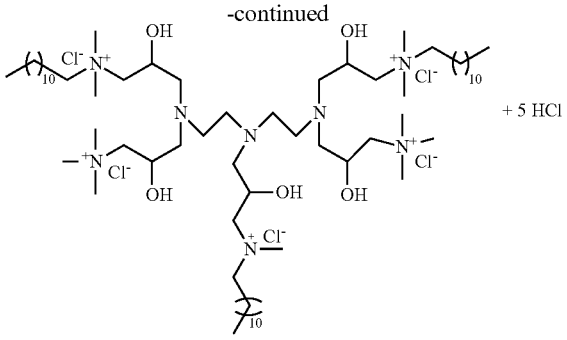

Mn: 1322.5 Formula: $C_{67}H_{149}O_5N_8Cl_5$
Compound 2

Compound 3 was synthesized using diethylenetriamine (1 mol) and (3-chloro-2-hydroxypropyl) lauryl dimethylammonium chloride (5 mol). Mass spectrometry confirmed synthesis of Compound 3: calc. $[M-2Cl^-]^{2+}$ 779.71, found 779.71; calc. $[M-3Cl^-]^{3+}$ 508.15, found 508.48; calc. $[M-4Cl^-]^{4+}$ 372.37, found 372.37.

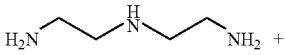

$C_4H_{13}N_3$ Mn: 103.2
1 mole

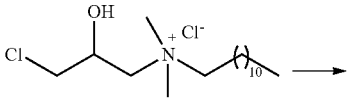

$C_{17}H_{37}Cl_2NO$ Mn: 342
5 moles

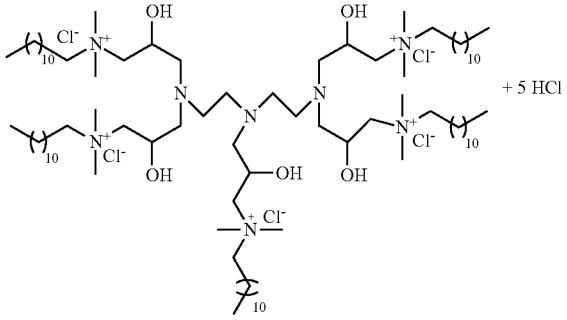

Compound 3

Compound 4 was synthesized using diethylenetriamine (1 mol), (3-chloro-2-hydroxypropyl) octadecyl dimethylammonium chloride (3 mol), and (3-chloro-2-hydroxypropyl) trimethylammonium chloride (2 mol).

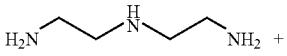

$C_4H_{13}N_3$ Mn: 103.2
1 mole

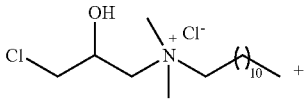

$C_{17}H_{37}Cl_2NO$ Mn: 426
3 moles

-continued

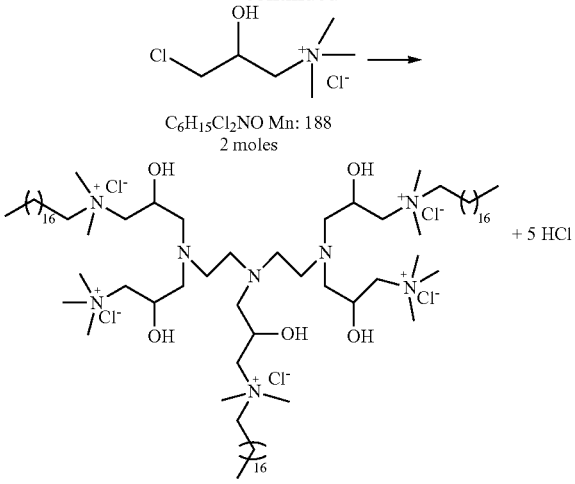

Compound 4

Compound 5 and 6 were synthesized similarly to Compounds 1-3, as described above. Mass spectrometry confirmed synthesis of Compound 5: calc. $[M-2Cl^-]^{2+}$ 548.45, found 549.45; calc. $[M-3Cl^-]^{3+}$ 353.98, found 354.64; calc. $[M-4Cl^-]^{4+}$ 256.74, found 256.74. Mass spectrometry confirmed synthesis of Compound 6: $[M-5Cl^-]^{5+}$ 167.56, found 167.56.

Compound 5

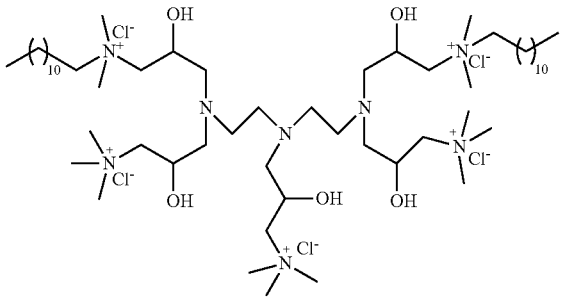

Compound 6

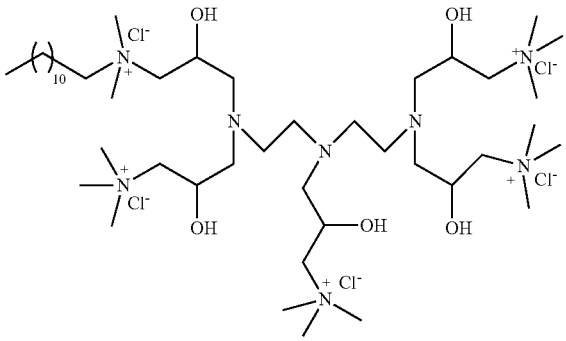

Compounds 7-13 were synthesized in a similar manner as compound 4 described above. Different ratios of reactants yielded different proportions of long chain alkyl groups in the cationic polymer. Compound 10 shows a different configuration of compound 4 and is synthesized in the same manner using the same reactants. Compound 13 was synthesized using TETA instead of DETA.

Compound 7

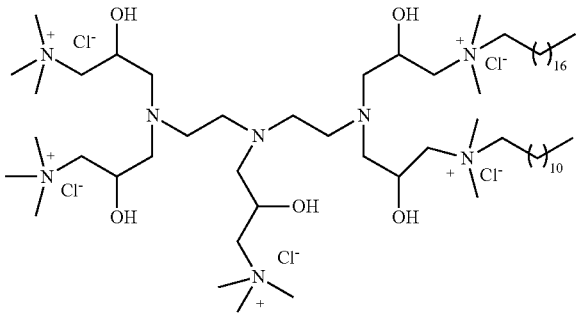

Compound 8

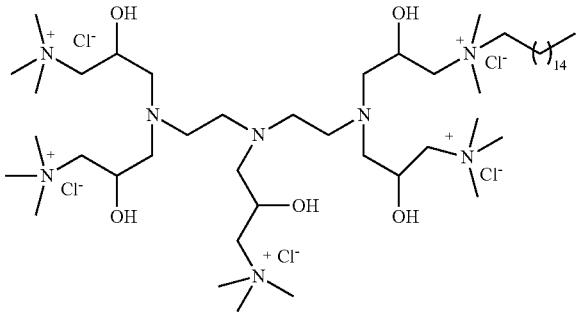

Compound 9

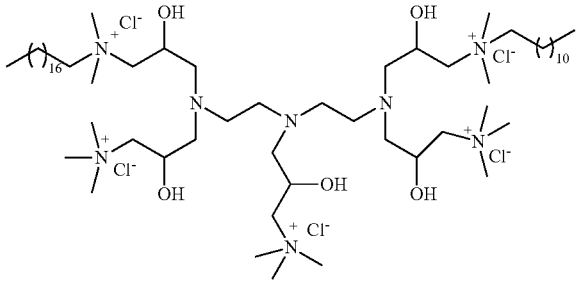

Compound 10

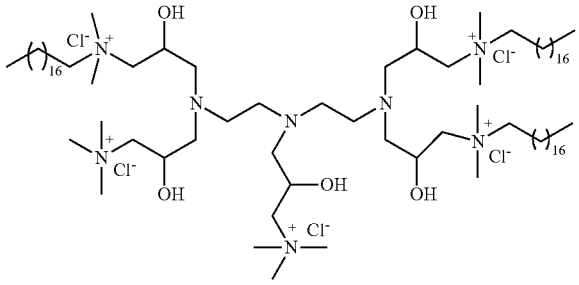

Compound 11

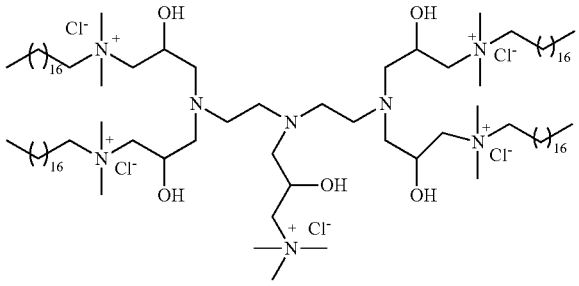

-continued

Compound 12

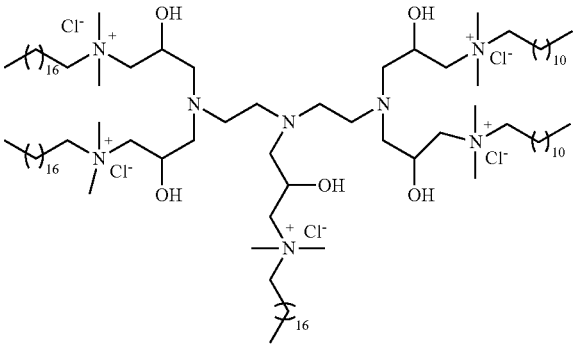

Compound 13

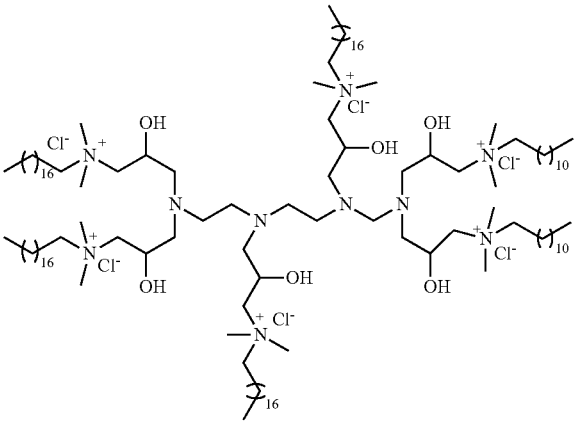

Various multiple cationic surfactants were synthesized using the above-mentioned synthetic scheme, e.g. DETA, TETA, 3-chloro-2-hydroxypropyl trimethylammonium chloride (QUAT 188™ cationic monomer from Dow Chemical Company of Midland, Mich.) and QUAB 426™ reactants, and the products are summarized in Table 1, below. Regarding the structures reported in Table 1, "5Q-1 Stearyl (C18)/4 trimethyl quats" means that the product has 5 total quaternary groups (5Q) of which 1 quat group had $R_1$ and $R_2$ as methyl and $R_3$ as stearyl, and 4 quat groups had $R_1$, $R_2$ and $R_3$ as methyl, and n=1. Likewise, "5Q-2 Stearyl (C18)/3 trimethyl quats" means that the product has 5 total quaternary groups (5Q) of which 2 quat groups had $R_1$ and $R_2$ as methyl and $R_3$ as stearyl, and 3 quat groups had $R_1$, $R_2$ and $R_3$ as methyl, and n=1. "5Q-3 Stearyl (C18)/2 trimethyl quats" means that the product has 5 total quaternary groups (5Q) of which 3 quat groups had $R_1$ and $R_2$ as methyl and $R_3$ as stearyl, and 2 quat groups had $R_1$, $R_2$ and $R_3$ as methyl, and n=1. "5Q-4 Stearyl (C18)/1 trimethyl quat" means that the product has 5 total quaternary groups (5Q) of which 4 quat groups had $R_1$ and $R_2$ as methyl and $R_3$ as stearyl, and 1 quat group had $R_1$, $R_2$ and $R_3$ as methyl, and n=1. "5Q-5 Stearyl (C18)" means that the product has 5 total quaternary groups (5Q) of which 5 quat groups had $R_1$ and $R_2$ as methyl and $R_3$ as stearyl, and n=1. "6Q-6 Stearyl(C18)" means that the product has 6 total quaternary groups (6Q) of which 6 quat groups had $R_1$ and $R_2$ as methyl and $R_3$ as stearyl, and n=2.

TABLE 1

Physical properties of multiple quaternary cationic surfactants

| Compound No. | Structure | Polyamine | Ratio of QUAB 426/QUAT188 | Solvent | Active, wt % Calculated, % | Active, wt % Measured, % |
|---|---|---|---|---|---|---|
| 7 | 5Q-1 Stearyl (C18)/4 trimethyl quats | DETA | 1/4 | Water/ Propanediol | 51.47 | 52.58 |
| 9 | 5Q-2 Stearyl (C18)/3 trimethyl quats | DETA | 2/3 | Water/ Propanediol | 46.54 | 51.3 |
| 10 | 5Q-3 Stearyl (C18)/2 trimethyl quats | DETA | 3/2 | Water/ Propanediol | 43.41 | 61.77 |
| 11 | 5Q-4 Stearyl (C18)/1 trimethyl quat | DETA | 4/1 | Water/ Propanediol/ PP425 | 33.68 | 62.88 |
| 12 | 5Q-5 Stearyl (C18) | DETA | 5/0 | Water/ Propanediol/ PP425 | 33.74 | 53.99 |
| 13 | 6Q-6 Stearyl (C18) | TETA | 6/0 | Water/ Propanediol/ PP425 | 33.28 | 49.40 |

The mass spectra of Compound 9 showed that the reaction product contained a mixture of 2-C18/3-Trimethyl (MS (ESI): calc. $[M-2Cl^-]^{2+}$ 632.545; found 632.5423; calc. $[M-3Cl^-]^{3+}$ 410.04, found 410.038; calc. $[M-4Cl^-]^{4+}$ 298.7875, found 298.786; calc. $[M-5Cl^-]^{5+}$ 232.036, found 232.210); 2-C16/3-Trimethyl (MS (ESI): calc. $[M-2Cl^-]^{2+}$ 604.51; found 604.51 calc. $[M-3Cl^-]^{3+}$ 391.35, found 391.35; calc. $[M-4Cl^-]^{4+}$ 284.77, found 284.77; calc. $[M-5Cl^-]^{5+}$ 220.824, found 220.555); 1-C18/1-C16/3-Trimethyl (MS (ESI): calc. $[M-2Cl^-]^{2+}$ 618.525; found 618.5266; calc. $[M-3Cl^-]^{3+}$ 400.697, found 400.694; calc. $[M-4Cl^-]^{4+}$ 291.78, found 291.778; calc. $[M-5Cl^-]^{5+}$ 226.43, found 226.429); 1-C18/4-Trimethyl (MS (ESI): calc. $[M-2Cl^-]^{2+}$ 513.41; found 513.4098; calc. $[M-3Cl^-]^{3+}$ 330.62, found 330.6166; calc. $[M-4Cl^-]^{4+}$ 239.22, found 239.2202; calc. $[M-5Cl^-]^{5}$ 184.38, found 184.3823); and 1-C16/4-Trimethyl (MS (ESI): calc. $[M-2Cl^-]^{2+}$ 449.395; found 449.4368; calc. $[M-3Cl^-]^{3+}$ 321.27, found 321.2728; calc. $[M-4Cl^-]^{4+}$ 232.21, found 232.212; calc. $[M-5Cl^-]^{5+}$ 178.776, found 178.776).

Example 4: Surface Tension Measurements and Critical Micelle Concentrations (CMC) Calculations Surface tension measurements were conducted on a Tracker tensiometer (Teclis Instruments) at room temperature. Various concentrations of surfactant solutions were prepared and measurements were conducted.

The surface tension as a function of concentration of the cationic surfactant samples were measured and are listed in Table 2, where NT means not tested.

TABLE 2

Summary of surface tensions of various cationic surfactant samples (mN/m)

| Concentration (%) | 7 | 9 | 10 | 11 | 12 | 13 |
|---|---|---|---|---|---|---|
| 0.010 | 73.70 | 73.11 | 70.99 | 63.52 | 63.16 | 63.28 |
| 0.025 | 72.05 | 69.16 | 61.99 | 60.01 | 55.77 | 59.04 |
| 0.050 | 64.84 | 60.77 | 57.33 | 56.35 | 51.89 | 55.36 |
| 0.100 | 60.93 | 54.69 | 52.64 | 53.23 | 49.42 | 52.65 |
| 0.200 | 57.12 | 52.05 | 50.58 | 50.16 | 47.02 | 50.31 |

TABLE 2-continued

Summary of surface tensions of various cationic surfactant samples (mN/m)

| Concentration (%) | 7 | 9 | 10 | 11 | 12 | 13 |
|---|---|---|---|---|---|---|
| 0.500 | 55.13 | 50.09 | 47.92 | 47.38 | 45.02 | 48.02 |
| 1.000 | NT | 49.38 | 47.48 | 46.58 | 44.22 | 47.78 |
| 1.500 | NT | NT | NT | NT | 43.46 | NT |
| 2.000 | NT | NT | NT | NT | 42.97 | NT |

Surface tension of various cationic surfactant samples is also shown graphically in FIG. 1. In general, the magnitude of the surface tension drop was larger with an increasing number of stearyl groups on the surfactant molecule. The surface tension was measured using a Tracker tensiometer (Teclis Instruments) at room temperature.

Example 5: Synthesis of Multiple Quaternary Cationic Surfactants Based on a Reaction of a Polyalkyleneimine and a Substituted Alkyl Trialkyl Quaternary Ammonium Salt Polyethyleneimines (Lupasol G20 (50 wt % solution), 20 grams, 0.2204 mol —NH—) and 3-chloro-2-hydroxypropyl trimethylammonium chloride (69.06 grams, 60.0%, 0.2204 mol, (Sigma-Aldrich) were added to a 500 mL four-neck round bottom flask equipped with a mechanical stirrer, a thermometer, a temperature controller, a condenser, and an addition funnel. The reaction mixture was stirred and gently heated to 60° C. The pH value of the reaction was continuously monitored. Sodium hydroxide (50% aqueous solution) was slowly added to the reaction flask and the temperature was held constant at 60° C. The pH value of reaction solution was measured and was held constant above 7.5. The reaction temperature was raised to 85° C. and held constant for 5 hours. Compound 14 depicted below is a depiction of a generalized reaction product. The structure below depicts that all of the secondary and primary amines in the polyethyleneimine react with the 3-chloro-2-hydroxypropyl trimethylammonium chloride so that no secondary amines remain. There may be some amines that do not completely react leaving some secondary amines in the cationic polymer salt.

Compound 14

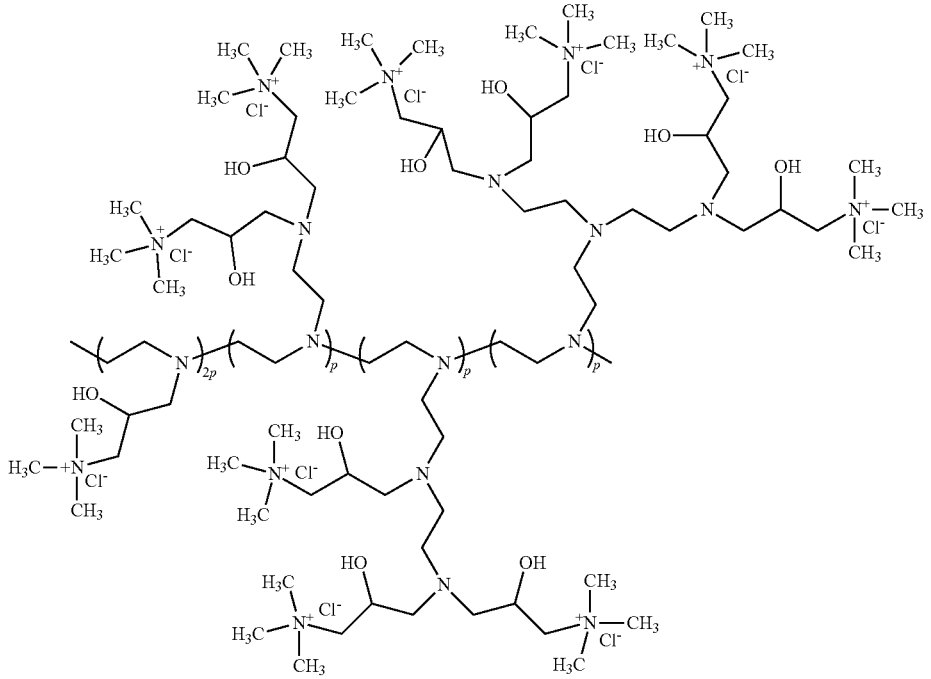

Multiple quaternary cationic surfactants with stearyl chains were synthesized by reacting polyethyleneimines branched (Sigma-Aldrich) with 3-chloro-2-hydroxypropyl-stearyldimethylammonium chloride (QUAB 426™ from Quab Chemicals, Saddle Brook, N.J.) and 3-chloro-2-hydroxypropyl trimethylammonium chloride (Sigma-Aldrich). Polyethyleneimines (40.0 grams (50%), 0.4206 mol —NH—) and 3-chloro-2-hydroxypropyl-stearyldimethyl-ammonium chloride (47.15 grams, 38.5 wt. %, 0.0426 mol) and 3-chloro-2-hydroxypropyl trimethylammonium chloride (118.6 grams, (60%), 0.3785 mol) were charged to a 500 mL four-neck round bottom flask equipped with a mechanical stirrer, a thermometer, a temperature controller, a condenser, and an addition funnel. The reaction mixture was stirred and gently heated to 60° C. The pH value of the reaction was continuously monitored. Sodium hydroxide (50% aqueous solution) was slowly added to the reaction flask and the temperature was held constant at 60° C. The pH value of reaction solution was measured and was held constant above 7.5. The reaction temperature was raised to 85° C. and held constant for 5 hours. Surface tension, 41.55 mN/m at 0.050 wt % aqueous solution. Compound 15 shows a generalized reaction product. Like Compound 14, there may be some secondary amines present if the reaction did not proceed to completion.

Polymeric quaternary compounds were synthesized according to the procedures described above to produce Compound 15 and Compound 16. Compound 16 had a weight average molecular weight of about 1300 gm/mol as measured by gel permeation chromatography. Compound 15 had a weight average molecular weight of about 25,000 gm/mol as measured by gel permeation chromatography. The variable "p" may range from about 10 to about $10^5$.

Compound 15

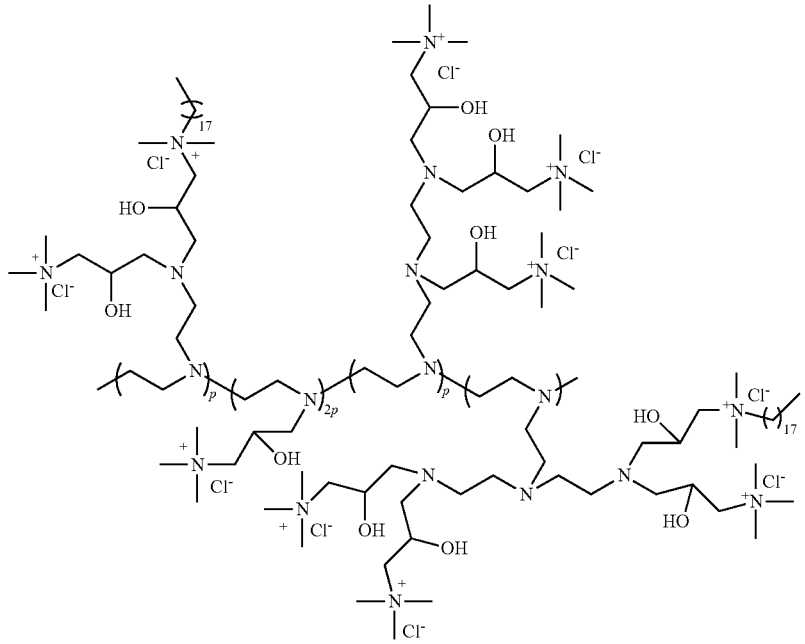

-continued

Compound 16

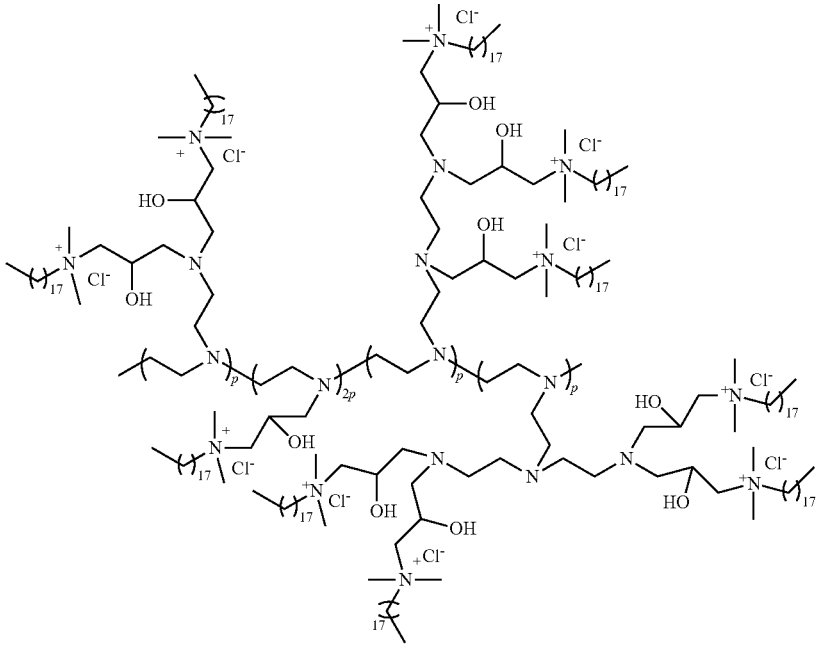

Example 6: Peel Force Measurements of Yankee Coatings with Quaternary Cationic Surfactants In this example, Compounds 1, 3, and 11 were tested to determine their effectiveness at lowering peel adhesion. Peel adhesion is measured as a material is peeled off of a surface that was coated with the test composition. The coating film was composed of a non-crosslinking PAE and 1.4 wt. % of the described samples in Table 3, the remainder of the composition being water. The percent change in peel force is calculated compared to a coating of non-crosslinking PAE without any quaternary cationic surfactants disclosed herein.

TABLE 3

Peel Force Measurements

| Sample | Compound structure | Percent Change in Peel Force |
|---|---|---|
| Compound 1 | 2 trimethyl; 3 lauryl | −23 |
| Compound 3 | 5 lauryl | −3 |
| Compound 11 | 1 trimethyl; 4 stearyl | −38 |

Other quaternary cationic surfactants were tested. The coating film was composed of a non-crosslinking PAE and 1.4 wt. % of the respective compounds. The quaternary cationic surfactants decreased adhesion compared to a film without quaternary cationic surfactants.

TABLE 4

Release Testing of Quaternary Surfactants

| Sample | Number of Stearyl Groups | Change in adhesion from blank |
|---|---|---|
| Compound 4/10 | 3 | −34% |
| Compound 7 | 1 | −25% |
| Compound 12 | 5 | −32% |

TABLE 4-continued

Release Testing of Quaternary Surfactants

| Sample | Number of Stearyl Groups | Change in adhesion from blank |
|---|---|---|
| Compound 12* | 5 | −26% |
| Compound 13* | 6 | −38% |

*These two samples were solids in the form of a paste. The paste was dispersed in the adhesive prior to testing.

Example 7: Effect of Concentration on Adhesion

In a separate test, Compound 4/10 was evaluated for its effectiveness in decreasing adhesion of a Yankee coating film at different concentrations. The coating film was again composed of a non-crosslinking PAE and 1.0 or 2.0 wt. % of Compound 4/10. The results in Table 5 show a good releasing effect due to the addition of the surfactant.

TABLE 5

Release Testing of Compound 4/10

| Concentration in Film (wt %) | Change in Adhesion from Blank |
|---|---|
| 1 | −33% |
| 2 | −43% |

Example 8: PEI-Bases Quaternary Cationic Polymers Effect on Adhesion in Yankee Coatings In this example, quaternary groups were attached to PEI-based polymers to provide Yankee coating release agents. A description of the modified PEI polymers that were tested is provided in Table 6. Compounds 17 and 18 were synthesized according to the procedures described in Example 5 but with different ratios of methyl-substituted to strearyl-substituted quaternary amines.

TABLE 6

| Quaternized PEI Polymers | | | |
|---|---|---|---|
| Sample | PEI base | PEI MW (Da) | Quat modification |
| Compound 14 | Lupasol FT WF | 25,000 | trimethyl |
| Compound 17 | Lupasol FT WF | 25,000 | Trimethyl + stearyl (9:1) |
| Compound 18 | Lupasol PS | 750,000 | Trimethyl + stearyl (9:1) |

Table 7 shows the change in adhesion compared to a coating of non-crosslinking PAE. The coating film was composed of a non-crosslinking PAE and 2.0 wt. % of the modified PEI was added to the film. These samples provided good release with better release observed when Compounds 17 and 18 were used. Visual inspection showed improved film uniformity when the modified PEI polymers were added to the non-crosslinking PAE film compared to the quaternary surfactants having about 5 quaternary amines.

TABLE 7

| Release Testing of Modified PEI Polymers | |
|---|---|
| Sample | Change in adhesion from blank |
| Compound 14 | −19% |
| Compound 17 | −62% |
| Compound 18 | −52% |

Example 9: Quaternary Cationic Surfactants as Debonding Agents

In this example quaternary cationic surfactants were evaluated as debonding agents to reduce dry tensile strength of paper sheets. Compound 7 or Compound 4/10 was added to a papermaking furnish at levels of about 3 and about 6 lb/Ton actives/dry fiber basis. The furnish was a 70/30 hardwood/softwood blend, prepared from dry lap pulps, to about 0.5% consistency thin stock. Laboratory handsheets were prepared from the thin stock, using a volume of about 500 mL to produce a target basis weight sheet of about 60 grams/m$^2$ on a Nobel and Wood sheet mold. The forming wire used was 100 mesh. Prior to placing the 500 mL of thin stock in the handsheet mold, the stock was treated with either compound and mixed for one minute. The sheets were couched from the wire and wet pressed in a roll press at a pressure of 50 lb/in$^2$. The pressed sheets were then dried on an electrically heated drum dryer having a surface temperature of about 220° F. The prepared sheets were then conditioned in a controlled temperature (23° C.) and humidity (50%) room for 24 hours prior to testing.

Five handsheets were prepared for each condition evaluated. The sheets were measured for basis weight and dry tensile strength. Basis weight was measured on each sheet, while the dry tensile strength was measured on ten test strips cut from the 5 sheets. From these measurements the dry tensile index was calculated and the results are shown in Table 8. Both samples showed the ability to decrease dry tensile strength of the handsheets.

TABLE 8

| Loss in Tensile Strength in Handsheets Dosed with Quaternary Surfactants | | | |
|---|---|---|---|
| Sample | Dry Tensile Index (Nm/g) | | |
| Dose (lb/T) | 0 | 3 | 6 |
| Compound 7 | 23.27 | 20.59 | 21.03 |
| Compound 4/10 | 23.27 | 20.37 | 18.46 |

Any composition disclosed herein may comprise, consist of, or consist essentially of any of the compounds/components disclosed herein. In accordance with the present disclosure, the phrases "consist essentially of," "consists essentially of," "consisting essentially of," and the like limit the scope of a claim to the specified materials or steps and those materials or steps that do not materially affect the basic and novel characteristic(s) of the claimed invention.

As used herein, the term "about" refers to the cited value being within the errors arising from the standard deviation found in their respective testing measurements, and if those errors cannot be determined, then "about" refers to within 10% of the cited value.

All of the compositions and methods disclosed and claimed herein can be made and executed without undue experimentation in light of the present disclosure. While this invention may be embodied in many different forms, there are described in detail herein specific preferred embodiments of the invention. The present disclosure is an exemplification of the principles of the invention and is not intended to limit the invention to the particular embodiments illustrated. In addition, unless expressly stated to the contrary, use of the term "a" is intended to include "at least one" or "one or more." For example, "a surfactant" is intended to include "at least one surfactant" or "one or more surfactants."

Any ranges given either in absolute terms or in approximate terms are intended to encompass both, and any definitions used herein are intended to be clarifying and not limiting. Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges (including all fractional and whole values) subsumed therein.

Furthermore, the invention encompasses any and all possible combinations of some or all of the various embodiments described herein. It should also be understood that various changes and modifications to the presently preferred embodiments described herein will be apparent to those skilled in the art. Such changes and modifications can be made without departing from the spirit and scope of the invention and without diminishing its intended advantages. It is therefore intended that such changes and modifications be covered by the appended claims.

What is claimed is:

1. A composition comprising:

an adhesive agent; and a release aid comprising a cationic polymer salt comprising a reaction product of a polyamine or a polyalkyleneimine and a substituted alkyl trialkyl quaternary ammonium salt of formula (I):

(I)

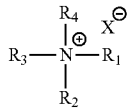

wherein each $X^-$ is independently an anion; $R_1$ is $C_1$-$C_6$ alkylene substituted with hydroxyl or —$OR_5$ and an $X^-$ end group; $R_2$, $R_3$, and $R_4$ are each independently $C_1$-$C_{22}$ alkyl or $C_7$-$C_{22}$ arylalkyl; and $R_5$ is $C_1$-$C_6$ alkyl.

2. The composition of claim 1, wherein $R_2$, $R_3$, and $R_4$ are independently $C_1$-$C_{22}$ alkyl.

3. The composition of claim 1, wherein the substituted alkyl trialkyl quaternary ammonium salt is 3-chloro-2-hydroxypropyl-trimethylammonium chloride, 3-chloro-2-hydroxypropyl-dodecyl-dimethylammonium chloride, 3-chloro-2-hydroxypropyl-stearyl-dimethylammonium chloride, or any combination thereof.

4. The composition of claim 1, wherein the polyamine is of formula (II):

(II)

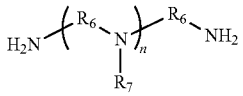

wherein n is an integer from 0 to 100;

each $R_6$ is independently $C_2$-$C_6$ alkylene; and each $R_7$ is independently hydrogen or —$R_6$—$NH_2$, —$R_6$—NH—$R_6$—$NH_2$, or —$R_6$—N—($R_6$—$NH_2$)$_2$.

5. The composition of claim 1, wherein the reaction product is of formula (III):

(III)

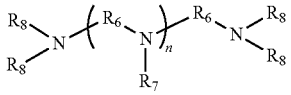

wherein each $R_6$ is independently $C_2$-$C_6$ alkylene; each $R_7$ is independently hydrogen, —$R_8$, —$R_6$—N($R_8$)$_2$, —$R_6$—N($R_8$)—$R_6$—N($R_8$)$_2$, or —$R_6$—N—($R_6$—N($R_8$)$_2$)$_2$; each $R_8$ is independently hydrogen or

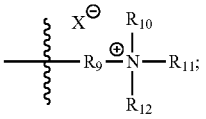

each $R_9$ is independently $C_2$-$C_6$ alkylene substituted with hydroxyl or —$OR_{13}$; $R_{10}$, $R_{11}$, and $R_{12}$ are each independently $C_1$-$C_{22}$ alkyl or $C_7$-$C_{22}$ arylalkyl; $R_{13}$ is $C_1$-$C_6$ alkyl; n is an integer from 1 to 100; and each $X^-$ is independently an anion.

6. The composition of claim 4, wherein $R_6$ is ethyl.

7. The composition of claim 1, wherein the reaction product is selected from the group consisting of:

Compound 1

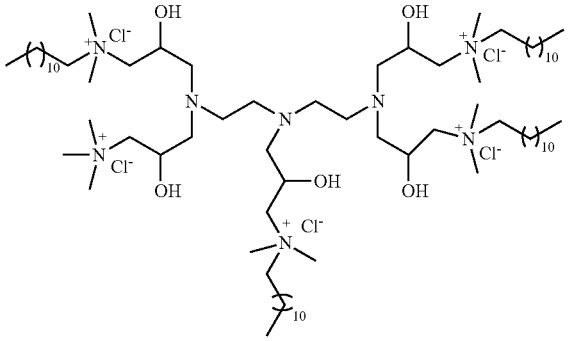

Compound 3

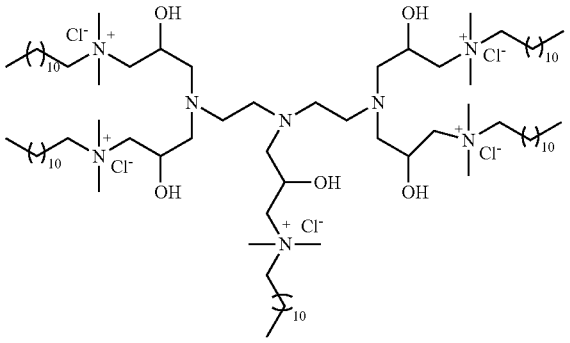

Compound 7

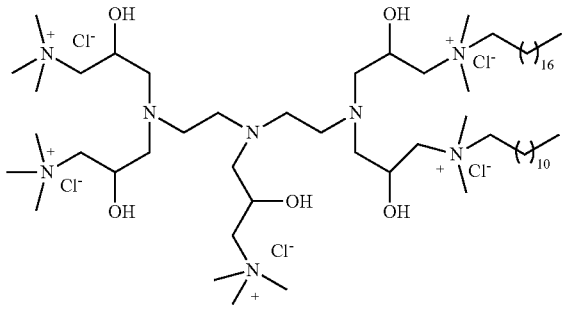

Compound 9

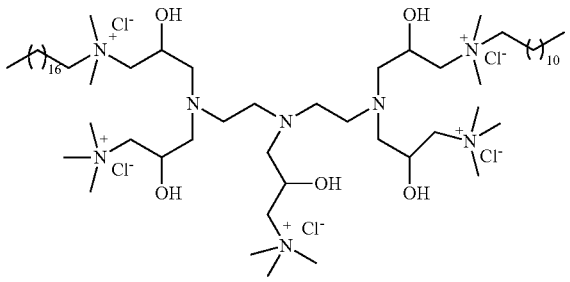

-continued

Compound 10

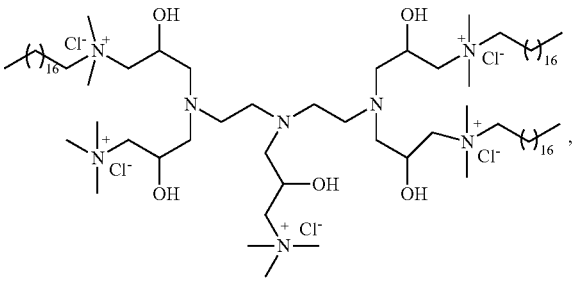

Compound 11

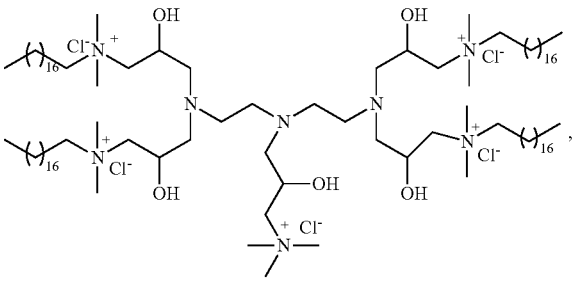

Compound 12

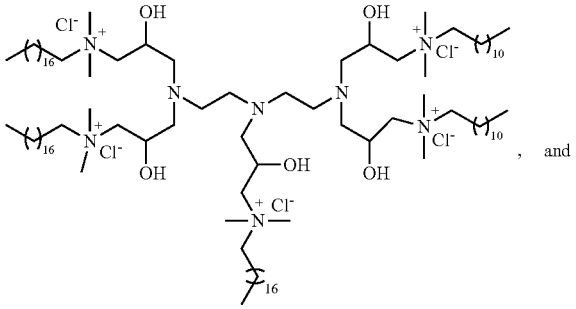

Compound 13

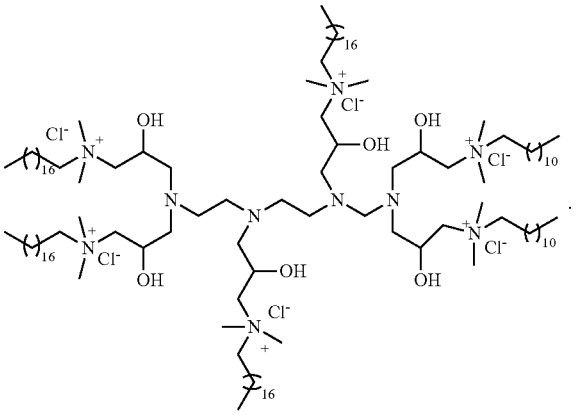

8. The composition of claim 1, wherein the reaction product is of a polyethylenimine and the substituted alkyl trialkyl quaternary ammonium salt of formula (I).

9. The composition of claim 1, wherein the adhesive agent is selected from polyaminoamide-epichlorohydrin (PAE) resins, polyamine-epichlorohydrin resins, polyvinyl alcohols, polyvinyl acetates, polyacrylamides, polyamines, hydrolyzed N-vinylformamide polymers, polyamides, polyvinylpyrrolidones, polyethers, polyethyleneimines, cross-linked vinyl alcohol copolymers, starch, guar gum, carboxymethyl cellulose, hydroxyethyl cellulose, hydroxypropyl cellulose, and any combination thereof.

10. The composition of claim 1, further comprising a modifying agent.

11. The composition of claim 10, wherein the modifying agent is selected from glycerol, diglycerol, triglycerol, polyglycerol, and any combination thereof.

12. The composition of claim 1, wherein the composition comprises about 0.01% to about 95% by weight of the release aid.

13. A Yankee dryer coating, comprising a release aid comprising a cationic polymer salt comprising a reaction product of a polyamine or a polyalkyleneimine and a substituted alkyl trialkyl quaternary ammonium salt of formula (I):

(I)

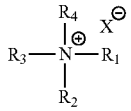

wherein each $X^-$ is independently an anion; $R_1$ is $C_1$-$C_6$ alkylene substituted with hydroxyl or —$OR_5$ and an $X^-$ end group; $R_2$, $R_3$, and $R_4$ are each independently $C_1$-$C_{22}$ alkyl or $C_7$-$C_{22}$ arylalkyl; and $R_5$ is $C_1$-$C_6$ alkyl.

14. The Yankee dryer coating of claim 13, wherein the reaction product is of formula (III):

(III)

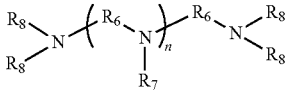

wherein each $R_6$ is independently $C_2$-$C_6$ alkylene; each $R_7$ is independently hydrogen, —$R_8$, —$R_6$—$N(R_8)_2$, —$R_6$—$N(R_8)$—$R_6$—$N(R_8)_2$, or —$R_6$—N—($R_6$—$N(R_8)_2)_2$; each $R_8$ is independently hydrogen or

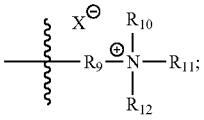

each $R_9$ is independently $C_2$-$C_6$ alkylene substituted with hydroxyl or —$OR_{13}$; $R_{10}$, $R_{11}$, and $R_{12}$ are each independently $C_1$-$C_{22}$ alkyl or $C_7$-$C_{22}$ arylalkyl; $R_{13}$ is $C_1$-$C_6$ alkyl; n is an integer from 1 to 100; and each $X^-$ is independently an anion.

15. The Yankee dryer coating of claim 13, wherein the Yankee dryer coating comprises about 0.01% to about 95% by weight of the release aid.

16. A method of creping a paper web comprising:

applying to a creping cylinder the composition of claim 1;

pressing the paper web against the creping cylinder to effect adhesion of the paper web to the creping cylinder; and dislodging the paper web from the creping cylinder with a doctor blade.

17. A method of treating paper, comprising:

adding a cationic polymer salt to cellulose fibers, the cationic polymer salt comprising a reaction product of a polyamine or a polyalkyleneimine and a substituted alkyl trialkyl quaternary ammonium salt of formula (I):

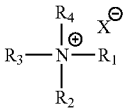

(I)

wherein each $X^-$ is independently an anion; $R_1$ is $C_1$-$C_6$ alkylene substituted with hydroxyl or —$OR_5$ and an $X^-$ end group; $R_2$, $R_3$, and $R_4$ are each independently $C_1$-$C_{22}$ alkyl or $C_7$-$C_{22}$ arylalkyl; and $R_5$ is $C_1$-$C_6$ alkyl.

18. The method of claim 17, wherein the polyamine is of formula (II):

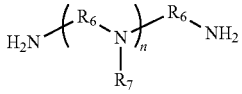

(II)

wherein n is an integer from 0 to 100;

each $R_6$ is independently $C_2$-$C_6$ alkylene; and each $R_7$ is independently hydrogen or —$R_6$—$NH_2$, —$R_6$—NH—$R_6$—$NH_2$, or —$R_6$—N—($R_6$—$NH_2$)$_2$.

19. The method of claim 17, wherein the cationic polymer salt is added to the cellulose fibers in a wet-end of a papermaking machine or the cationic polymer salt is added to cellulose fibers by spraying the cationic polymer salt onto a sheet comprising the cellulose fibers after the paper sheet is formed.

* * * * *